US006205894B1

(12) United States Patent
Tanaka

(10) Patent No.: US 6,205,894 B1
(45) Date of Patent: Mar. 27, 2001

(54) AUTOMATIC STOP DEVICE FOR SCREW STRIKING MACHINE

(75) Inventor: Hiroshi Tanaka, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 09/339,110

(22) Filed: Jun. 24, 1999

(30) Foreign Application Priority Data

Jun. 24, 1998 (JP) ..... 10-177805
May 18, 1999 (JP) ..... 11-137877

(51) Int. Cl.[7] ..... B25B 23/151

(52) U.S. Cl. ..... 81/470; 81/57.13; 173/12; 227/8

(58) Field of Search ..... 81/470, 429, 469, 81/57.13; 173/4, 10, 11, 13, 12; 227/142, 8, 136

(56) References Cited

U.S. PATENT DOCUMENTS 4,307,784 * 12/1981 Smith ..... 173/12
4,480,699 * 11/1984 Elmer ..... 173/12
4,880,064 * 11/1989 Willoughby et al. ..... 173/12
5,921,156 * 7/1999 Takezaki et al. ..... 81/57.13
5,996,874 * 12/1999 Fukushima et al. ..... 227/8

* cited by examiner

*Primary Examiner*—James G. Smith
*Assistant Examiner*—Hadi Shakeri
(74) *Attorney, Agent, or Firm*—Morgan, Lewis & Bockius LLP

(57) ABSTRACT

An automatic stop machine for a screw striking machine includes a driver bit, an air pressure cylinder having a piston, and an air motor driving the piston and rotationally driving the driver bit. The automatic stop machine comprises an open/close valve, a contact arm, and an air passage. The open/close valve is disposed in an air supply passage to the air motor. The contact arm freely slidable along a nose portion of the screw striking machine, projects from the leading end of the nose portion, and stops the air motor by closing the open/close valve when the contact arm is pushed into a main body of the screw striking machine and is moved upwardly as the screw is screwed. The air passage in which pressurized air passes from a space defined by a back surface of the piston in the piston when the piston reaches the vicinity of bottom dead point. Pressure of the pressurized air supplied through the air passage and upward movement of the contact arm cooperatively cause the open/close valve to close when the piston reaches the vicinity of bottom dead point.

10 Claims, 20 Drawing Sheets

AUTOMATIC STOP DEVICE FOR SCREW STRIKING MACHINE

BACKGROUND OF THE INVENTION

1. Field of the Invention

The present invention relates to an automatic stop device for use in a screw striking machine and, in particular, to an automatic stop device for use in a screw striking machine which automatically stops an air motor when a screwing operation is completed.

In addition, the present invention relates to an automatic stop device which can automatically stop the operation of the air motor when the screwing depth of the screw reaches a given depth especially in a condition that a screw is struck onto a member to be screwed in a floating condition by a screw striking machine and the screw is then rotated and tightened.

2. Description of the Related Prior Art

Conventionally, a screw striking machine uses high pressurized air as a power source. A driver bit connected to a piston of an air cylinder is driven and rotated by an air motor to thereby strike a screw into a member to be screwed. In this type of screw striking machine, as a safety device, a contact arm is disposed and projected from the nose portion of the screw striking machine. The contact arm is energized by a spring in a direction where the screw is struck. Due to the contact arm, a trigger lever is operable when the leading end portion of the contact arm is pressed against the surface of the member to be screwed and the other end portion of the contact arm is butted against a contact arm stopper disposed within the screw striking machine.

If the trigger lever is actuated, then a piston within the air cylinder is rapidly lowered; and, in response to this, the driver bit connected to the piston drives a screw into the member to be screwed such as a building material or the like to a certain degree and, at the same time, the locking of the contact arm by the contact arm stopper is removed, so that the air motor drives and rotates the driver bit to thereby screw the screw into the member to be screwed. If the operation of the trigger lever is removed, then the operation of the air motor is caused to stop, and thus the piston and driver bit respectively move upward to return back to their wait positions.

As for another kind of a screw striking machine, when a screwing operation is completed, the operation of an air motor is automatically stopped to thereby control the screwing depth of a screw to a constant depth. In an automatic stop device for use in the screw striking machine of this type, the device includes an open/close valve in an air supply pipe passage to an air motor, and switches the open/close valve by a contact arm to thereby stop the operation of the air motor automatically.

In particular, if the screw is rotationally driven by the air motor and is thereby screwed into the member to be screwed, then a distance between the screw striking machine and the member to be screwed decreases, and the contact arm is further pushed in toward the main body side of the screw striking machine. In the above-mentioned automatic stop device, at the time of completion of the screwing operation, the contact arm presses against the stem of the open/close valve to thereby switch the open/close valve over to its pressurized air cut-off position, thereby stopping the operation of the air motor.

In another type of automatic stop device, a device is also structured such that, if a piston connected to a driver bit reaches its bottom dead point or one end of its travel as a screw is screwed, then a seal member attached to the piston cuts off an air supply passage to an air motor to thereby stop the operation of the air motor.

When striking a screw into a member to be screwed with the screw striking machine, in order for the driver bit to be able to drive and rotate the screw positively, it is necessary to press the contact arm of the screw striking machine against the member to be screwed with a certain degree of pressure. However, if the pressing load is excessive, then the driver bit and piston are pushed in toward the main body side of the screw striking machine prior to completion of the screwing operation, with the result that the contact arm is also pushed in. In particular, in a screw striking machine of a type that an open/close valve can be switched by the contact arm, if the above-mentioned state occurs, then there arises a problem that the operation of the air motor is caused to stop prior to completion of the screwing operation.

On the other hand, if the load with which the screw striking machine is pressed against the member to be screwed is too small, then there is a possibility that the screw striking machine can be removed from the surf ace of the member to be screwed due to a reactive force produced when the screw is struck by the screw striking machine. In a screw striking machine of a type that, when a piston reaches its bottom dead point, an air supply passage to an air motor is cut off, if the above-mentioned state occurs, then the piston reaches the bottom dead point prior to completion of the screwing operation, thereby causing the operation of the air motor to stop.

SUMMARY OF THE INVENTION

As described above, in the conventional screw striking machine including an automatic stop device, there is found a problem that the screw is tightened poorly if the pressing load of the screw striking machine against the member to be screwed is excessive or too small. The invention aims at eliminating the drawbacks found in the above-mentioned conventional automatic stop device for use in a screw striking machine. Accordingly, it is a first object of the invention to provide an automatic stop device for use in a screw striking machine which, regardless of the pressing load to be applied to the screw striking machine, can continue the rotation of an air motor positively until a screwing operation is completed, thereby being able not only to prevent the poorly screwed screw but also to facilitate the screwing operation.

In addition, it is a second object of the invention to provide an automatic stop device for a screw striking machine which, even if the screw striking machine, in its screwing operation, is strongly pressed against a member to be screwed and a piston is thereby pushed into the main body of the screw striking machine, can prevent effectively an air motor from being stopped and can stop the air motor for the first time on completion of a given screwing operation. Moreover, the present invention also aims to attain the above-mentioned operation even in the short duration of an actual screwing operation, for example, within 0.1 second.

In attaining the above-mentioned first object, according to the invention, there is provided an automatic stop machine for a screw striking machine includes a driver bit, an air pressure cylinder having a piston, and an air motor driving the piston and rotationally driving the driver bit. The automatic stop machine comprises a primary open/close valve, a contact arm, and an air passage. The primary open/close valve is disposed in an air supply passage to the air motor.

The contact arm freely slidable along a nose portion of the screw striking machine, projects from the leading end of the nose portion, and stops the air motor by closing the primary open/close valve when the contact arm is pushed into a main body of the screw striking machine and is moved upwardly as the screw is screwed. The air passage in which pressurized air passes from a space defined by a back surface of the piston in the piston when the piston reaches the vicinity of bottom dead point. Pressure of the pressurized air supplied through the air passage and upward movement of the contact arm cooperatively cause the primary open/close valve to close when the piston reaches the vicinity of bottom dead point.

Preferably, the automatic stop machine for a screw striking machine further comprises a gear including a center hole with a spline groove in the screw striking machine, wherein the driver bit includes a spline shaft to be inserted into the gear and is rotatably driven by the air motor through the gear.

It is more preferable that the pressure of the pressurized air is supplied from the space in the piston to the primary open/close valve when the piston reaches the vicinity of bottom dead point.

It is also preferable that the automatic stop machine for a screw striking machine further comprises a secondary open/close valve of pilot operation type including an entrance port and a pilot port and a stem opening and closing the pilot air chamber of the primary open/close valve. The primary open/close valve is pilot operation type and includes a vent port of a pilot air chamber. The vent port is connected to the entrance port of the secondary open/close valve, the air passage is connected to the pilot port of the secondary open/close valve, and the primary open/close valve is closed by discharge of pressurized air in the pilot air chamber through the secondary open/close valve when the piston reaches the vicinity of the bottom dead point of the piston to thereby open the secondary open/close valve and the contact arm pushes the stem.

In achieving the above-mentioned second object, according to the invention, there is provided that the automatic stop machine for a screw striking machine further comprises a pilot air chamber, a secondary open/close valve, and an air chamber. The pilot air chamber is in the primary open/close valve, and the secondary open/close valve opens and closes the air passage communicating with the pilot air chamber with respect to the open air due to the pressurized air acting on the back surface of the piston when the piston reaches the vicinity of bottom dead point. The air chamber actuates the secondary open/close valve in the air passage and includes an exhaust hole to discharge the pressurized air and to be opened and closed in linking with the upward and downward movements of the contact arm. The primary open/close valve is pilot operation type, and the primary open/close valve is closed by discharge of the pressurized air in the pilot chamber of the primary open/close valve after the pressurized air has actuated the second open/close valve when the piston reaches the vicinity of the bottom dead point and the contact arm closes the exhaust hole after screwed.

DESCRIPTION OF THE PREFERRED EMBODIMENTS

Figure 1:
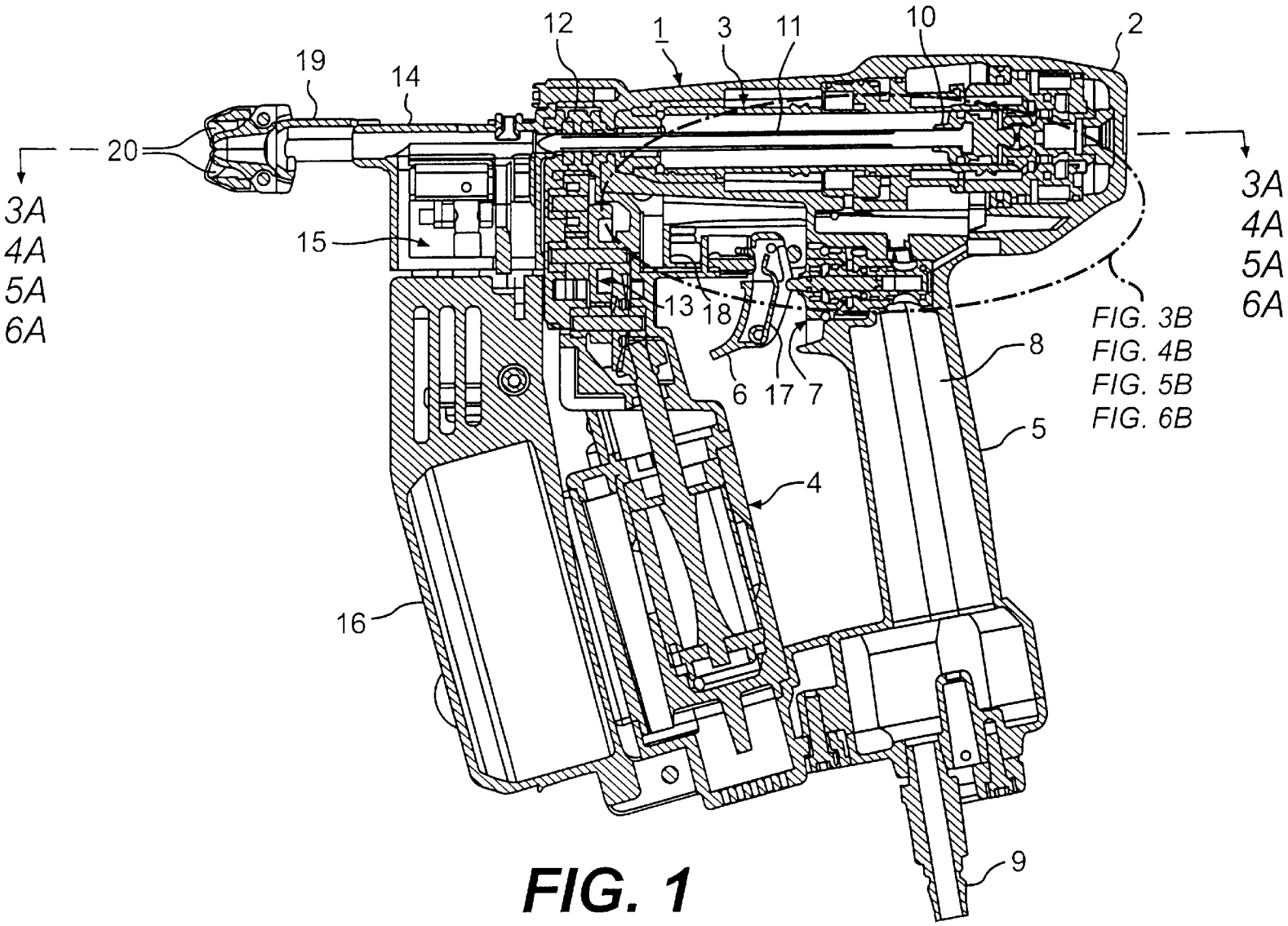
FIGS. 1 and 1A show section views of a screw striking machine according to the first embodiment of the present invention.

Now, description will be given below in detail of a first embodiment of an automatic stop device for use in a screw striking machine according to the invention with the accompanying drawings. In particular, FIG. 1 shows a screw striking machine 1 which is structured in the following manner. An air pressure cylinder 3 and an air motor 4 are stored within a housing 2. In the front portion of the grip portion 5 of the housing 2, a trigger lever 6 is disposed. The trigger lever 6 is capable of opening and closing a trigger valve 7 disposed within the grip portion 5. The interior portion of the grip portion 5 is formed as an air chamber 8. An air hose is connected to an air hose connector 9 mounted on the bottom portion of the grip portion 5, whereby pressurized air can be supplied to the air chamber 8 from an air compressor through the air hose.

The air pressure cylinder 3 includes a piston 10 to which a driver bit 11 is connected. The driver bit 11 includes a spline groove formed on the outer periphery thereof. The driver bit 11 is inserted into a hole with a spline groove formed in the center of a gear 12 mounted on the inside of the front portion of the housing 2. The piston 10 and driver bit 11 can be freely slid with respect to the gear 12. The power of the air motor 4 for driving the driver bit 11 rotationally is transmitted to a final-stage of the gear 12 through a plurality of reduction gears 13 respectively arranged in the front portion of the housing 2.

On the side surface of a nose portion 14 of the screw striking machine, a screw feed device 15 is disposed. The present screw feed device 15, similarly to an ordinary air nail driving machine, is composed of an air pressure cylinder and feed claws of a ratchet type (neither of which are shown), and it is used to feed or supply screws. The screws are respectively stored within a screw magazine 16 in a connected manner and sequentially supplied to the inside of the nose portion 14.

Figure 1A:
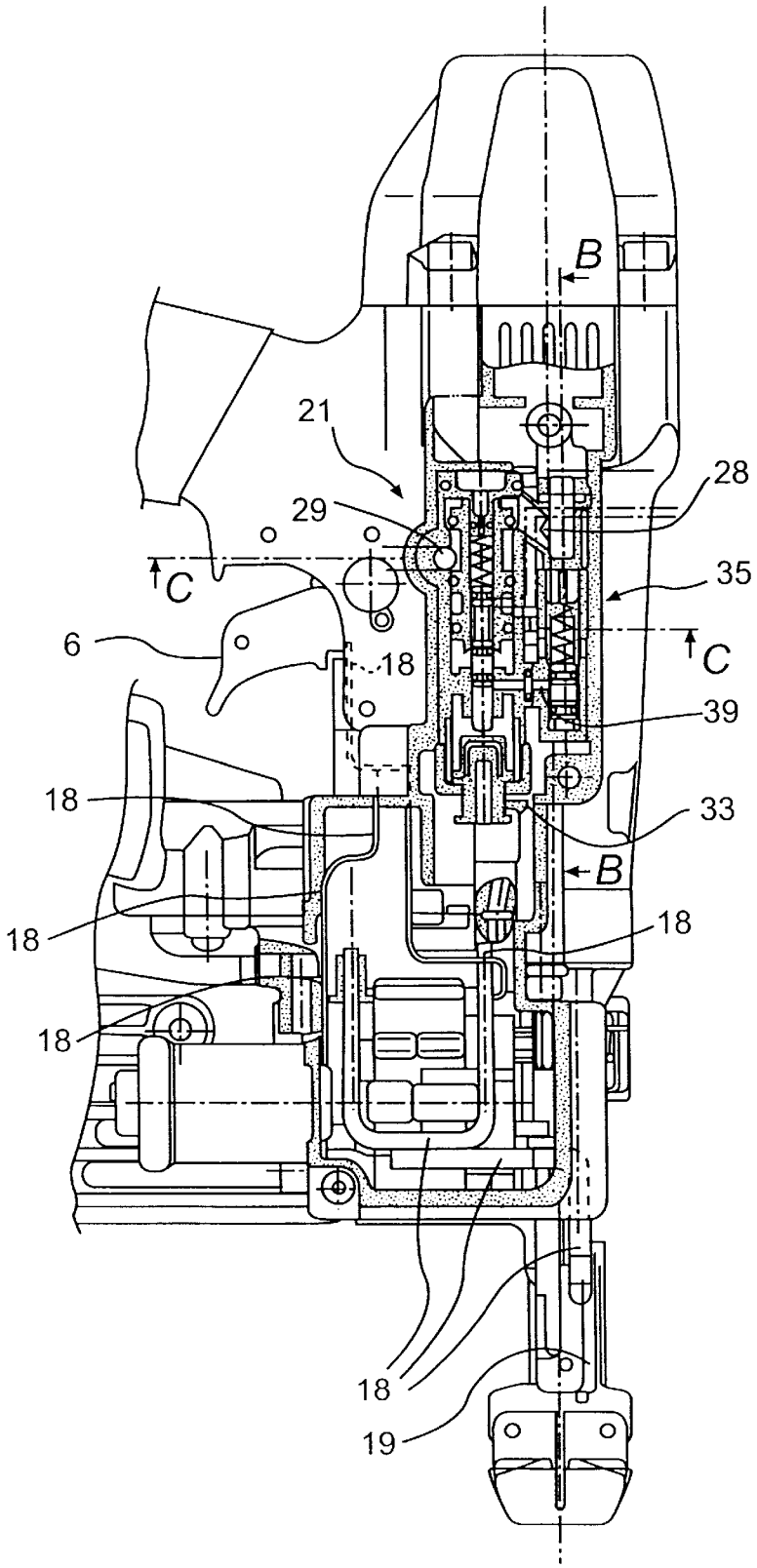

On the trigger lever 6, a free arm 17 is mounted and can be swung freely. A contact arm 18 is so arranged as to face the front surface of the free arm 17, and the contact arm 18 can be freely slid back and forth. In FIGS. 1 and 1A the contact arm 18 extends forward through the back surface side of the air pressure cylinder 3 and projects in a direction where the screws can be injected. The back-and-forth slidable contact arm 18 includes a screw guide 19 on the front portion thereof. On the screw guide 19, there a chuck 20 is pivotally mounted and can be freely opened and closed, while the chuck 20 is normally closed by a spring (not shown).

In this structure, the screw guide 19 is pressed against a member to be screwed such as a building material or the like to thereby push the contact arm 18 into the member to be screwed until the contact arm 18 is contacted with the leading end portion of the free arm 17. In this state, if the trigger lever 6 is rotationally operated, then the stem of the trigger valve 7 is pushed through the free arm 17 to thereby switch the state of the trigger valve 7, so that the air pressure cylinder 3 and air motor 4 cannot be operated only by the operation of the trigger lever 6. This structure is well known as a wrong screw injection preventive mechanism.

Figure 2:
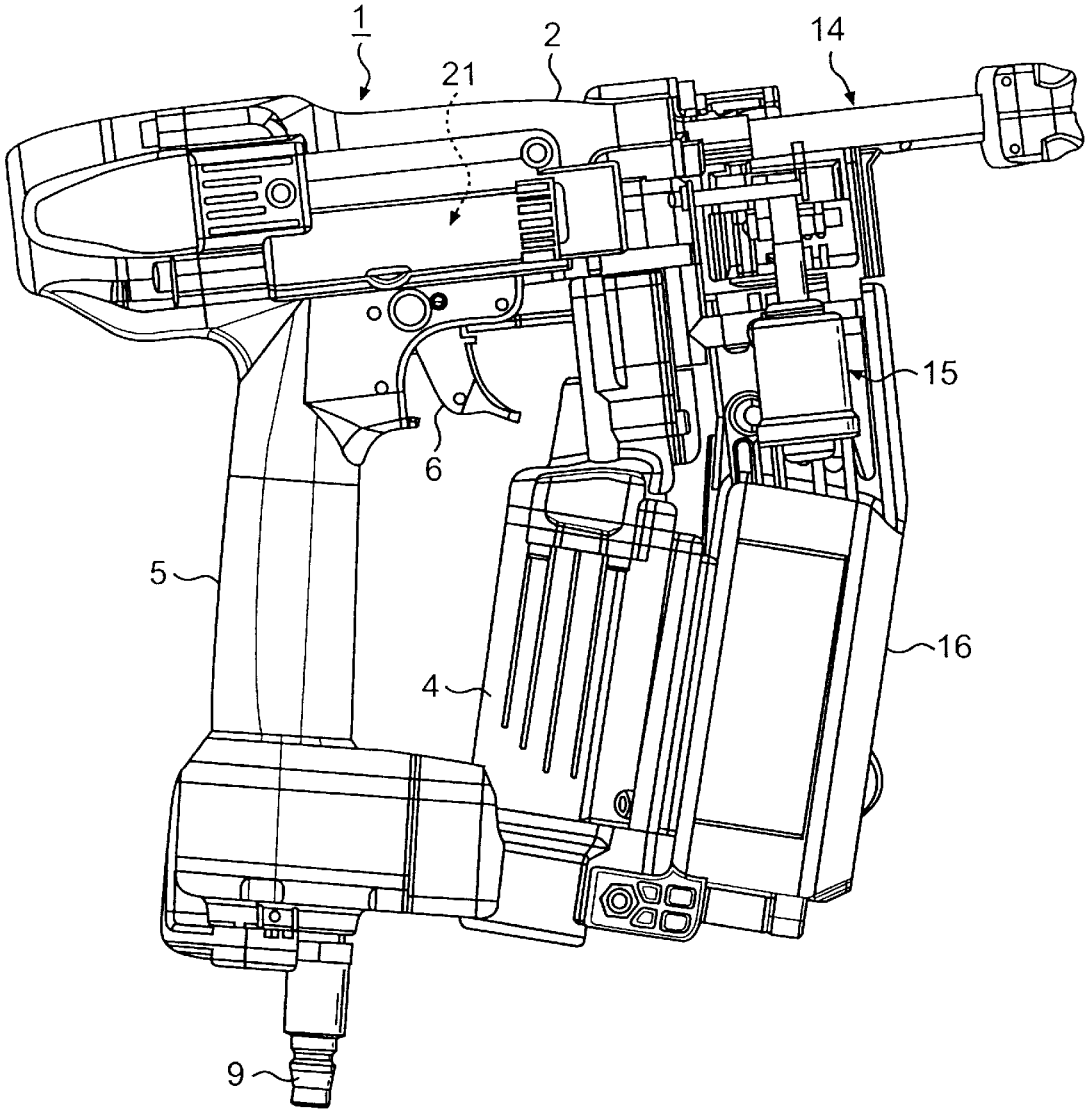
FIG. 2 is a side view of a screw striking machine according to the first embodiment of the present invention.

In the side surface portion (in FIG. 1, the back surface of the air pressure cylinder 3) of the housing 2 shown in FIG. 2, an automatic stop device 21 is incorporated. The automatic stop device 21 is composed of two open/close valves that can be used to open and close the air supply passage to the air motor 4.

Next, description will be given below of the automatic stop device 21 with reference to FIGS. 3A to 6B. FIGS. 3A to 6B, illustrate section views of a screw striking machine taken along lines 3A—3A, 4A—4A, 5A—5A, and 6A—A, and as enlargements of areas 3B, 4B, 5B and 6B in FIG. 1.

Figure 3A:
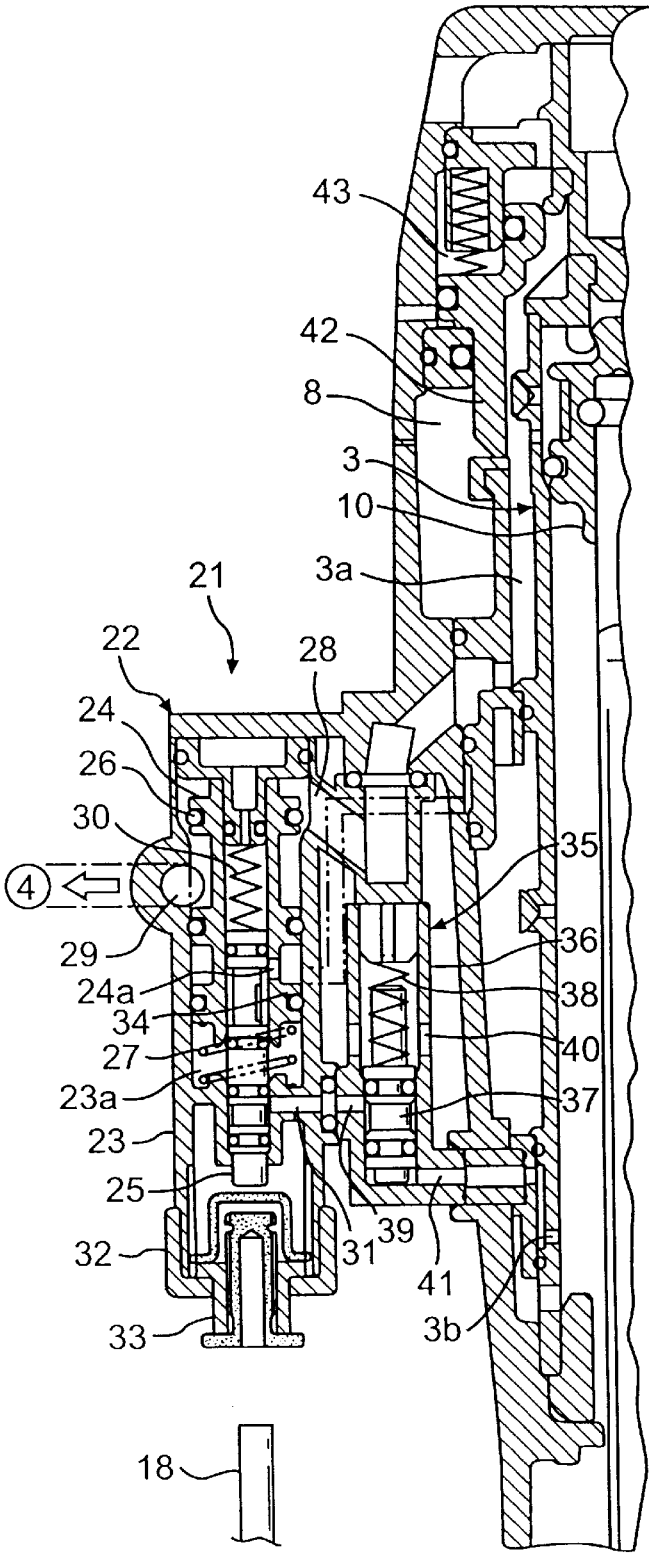
FIGS. 3A and 3B show partial section views of a screw striking machine, showing a first embodiment of an automatic stop device according to the invention.
Figure 3B:
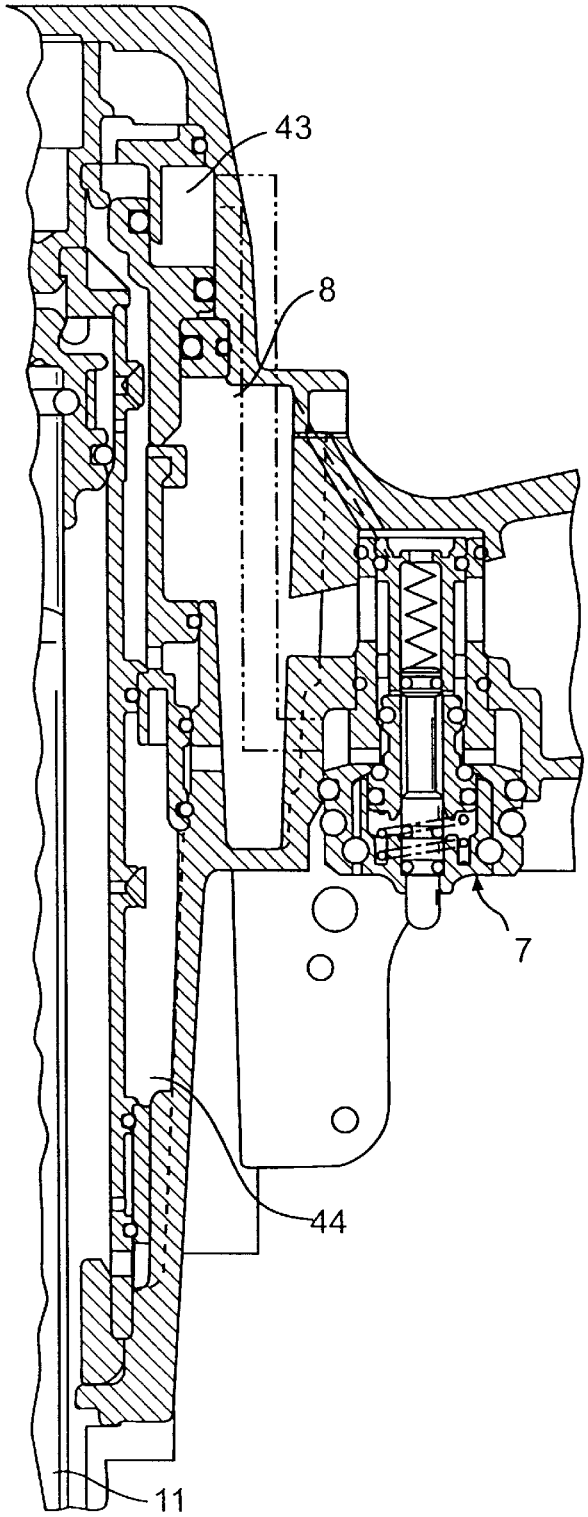

FIGS. 3A and 3B show a state in which the automatic stop device 21 is held in its wait state. The automatic stop device 21 includes a primary open/close valve 22. In particular, the primary open/close valve 22 is composed of a cylindrical-shaped main spool 24 and a small-diameter pilot spool 25. The cylindrical-shaped main spool 24 is inserted into a valve sleeve portion 23 of the automatic stop device 21, and the small-diameter pilot spool 25 is inserted into the lower portion of the main spool 24. On the respective lands of the main spool 24 and pilot spool 25, O rings 26 are mounted respectively.

The main spool 24 is held at its raised position due to the energizing force of a compression spring 27 as shown in FIG. 3A. At such position, an entrance port 28 and an exit port 29 respectively formed in the upper portion of the valve sleeve portion 23 are always in communication with each other. On the other hand, the pilot spool 25 is energized downward by a compression spring 30, which is inserted into the main spool 24, to thereby close a vent port 31 formed in the lower portion of the valve sleeve portion 23. The lower end portion of the pilot spool 25 projects downwardly of the main spool 24 through the center hole of the valve sleeve portion 23. The lower end portion of the pilot spool 25 faces a stem 33 mounted on the center hole of an adjust dial 32 which is installed on the lower end portion of the valve sleeve portion 23. The leading end of a branch portion, which is branched off in parallel from the middle portion of the contact arm 18, faces the lower surface of the stem 33.

The entrance port 28 of the primary open/close valve 22 is connected to an air chamber 3*a* formed on the head side of the back surface of the piston 10 of the air pressure cylinder 3. The exit port 29 thereof is connected to the air motor 4 and a pilot port 34 formed below the exit port 29 is connected to the air chamber 8. The main spool 24 includes, at a position thereof which corresponds to the pilot port 34, a passage 24*a* which extends through the internal space of the main spool 24, whereby the pressurized air of the air chamber 8 can be supplied to a pilot air chamber 23*a* formed on the lower surface of the main spool 24 through the interior portion of the main spool 24.

The automatic stop device 21 further comprises a secondary open/close valve 35 which is disposed in parallel to the primary open/close valve 22 and includes a valve sleeve portion 36. A spool 37, which is formed within the valve sleeve portion 36, is energized downward by a compression spring to thereby normally cut off the communication between an entrance port 39 and a vent port 40 which is formed upwardly of the entrance port 39. A pilot port 41, which is formed in the lower portion of the secondary open/close valve 35, is connected to an exit port 3*b* formed in the vicinity of the lower end portion of the air pressure cylinder 3 and, when the piston 10 reaches its bottom dead point, the pressurized air within the air pressure cylinder 3 is supplied to the pilot port 41 of the secondary open/close valve 35. The vent port 31 of the primary open/close valve 22 is connected to the entrance port 39 of the secondary open/close valve 35 and, when the secondary open/close valve 35 is opened, then the vent port 31 of the primary open/close valve 22 is allowed to communicate with the open air.

Next, description will be given below of the operation of a screw striking machine. If the leading end portion of the screw guide 19 shown in FIG. 1 is pressed against the surface of the member to be screwed to thereby push the contact arm 18 until the contact arm 18 is butted against a contact arm stopper (not shown) and the trigger lever 6 is actuated, then the trigger valve 7 is opened, so that the pressurized air of a pilot air chamber 43 acting on the outer edge portion of the upper surface of a head valve 42 of the air pressure cylinder 3A shown in FIG. 3 is discharged to the open air and the head valve 42 is caused to move upward in FIG. 3A. Due to this, the pressurized air flows into the air pressure cylinder 3 from the air chamber 8 located in the outer periphery of the air pressure cylinder 3, so that the piston 10 and driver bit 11 are respectively lowered down to thereby strike the screw within the nose portion 14 and, at the same time, the air motor 4 drives and rotates the driver bit 11, while the piston 10 is moved up to the neighboring portion of its bottom dead point.

If the screw is struck into the member to be screwed, then the locking of the contact arm 18 by the contact arm stopper is removed, and the screw is further screwed into the member to be screwed by the air motor 4. As the screw is screwed, the piston 10 is moved toward its bottom dead point and also the screw striking machine approaches the member to be screwed, so that the contact arm 18 is further pushed into the main body of the screw striking machine.

Figure 4A:
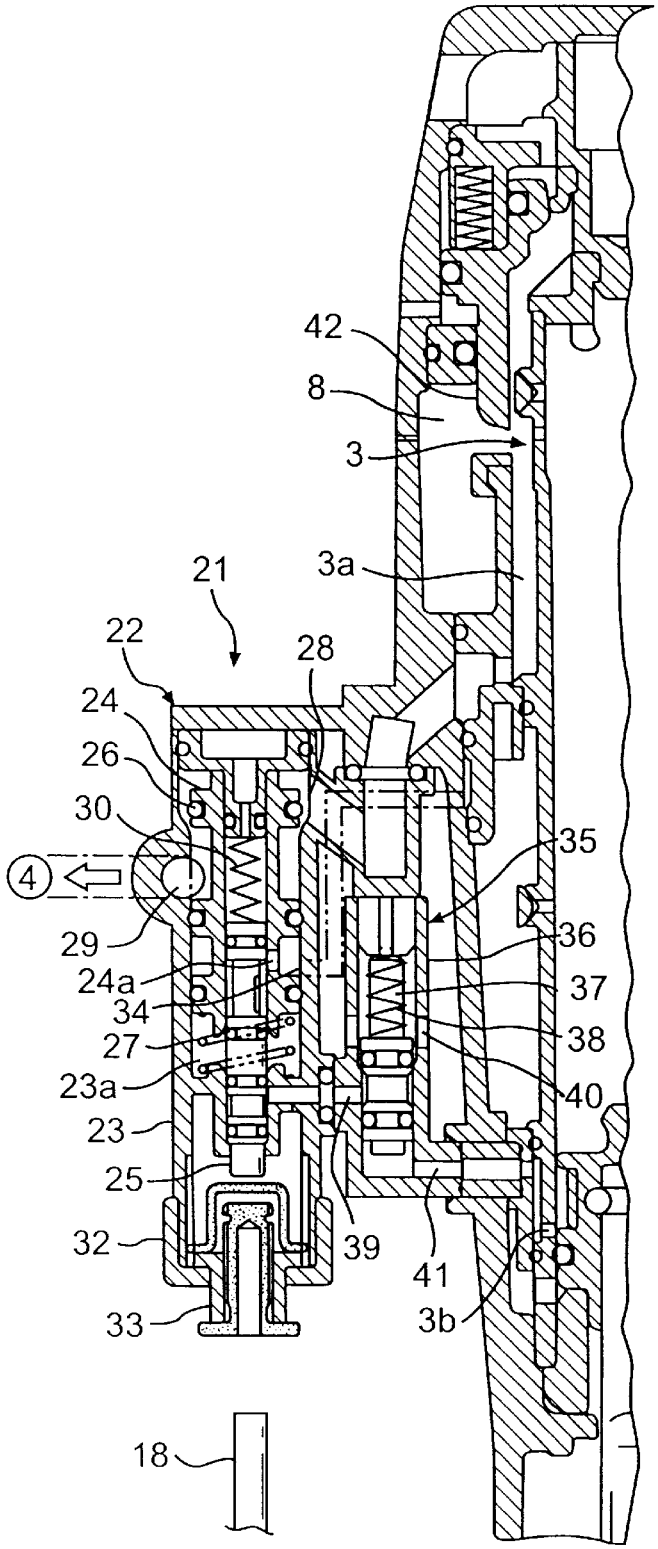
FIGS. 4A and 4B show partial section views of the screw striking machine, showing a state in which a secondary open/close valve shown in FIG. 3A is opened.

If the piston 10 passes through the exit port 3*b* of the air pressure cylinder 3 and reaches the bottom dead point, then the high pressurized air within the air pressure cylinder 3 is supplied through the exit port 3*b* to the pilot port 41 of the secondary open/close valve 35 to thereby open the secondary open/close valve 35 in such a manner as shown in FIG. 4A. On completion of the screwing operation, the contact arm 18 pushes up the stem 33 to thereby slide the pilot spool 25 of the primary open/close valve 22 upward.

If the pilot spool 25 is slid upward, then the pilot air chamber 23*a* of the lower surface of the main spool 24 and vent port 31 are allowed to communicate with each other and, at the same time, the communication between the pilot port 34 and pilot air chamber 23*a* is cut off, so that the pilot pressure acting on the lower surface of the main spool 24 is discharged from the vent port 31 to the open air through the secondary open/close valve 35.

Figure 5A:
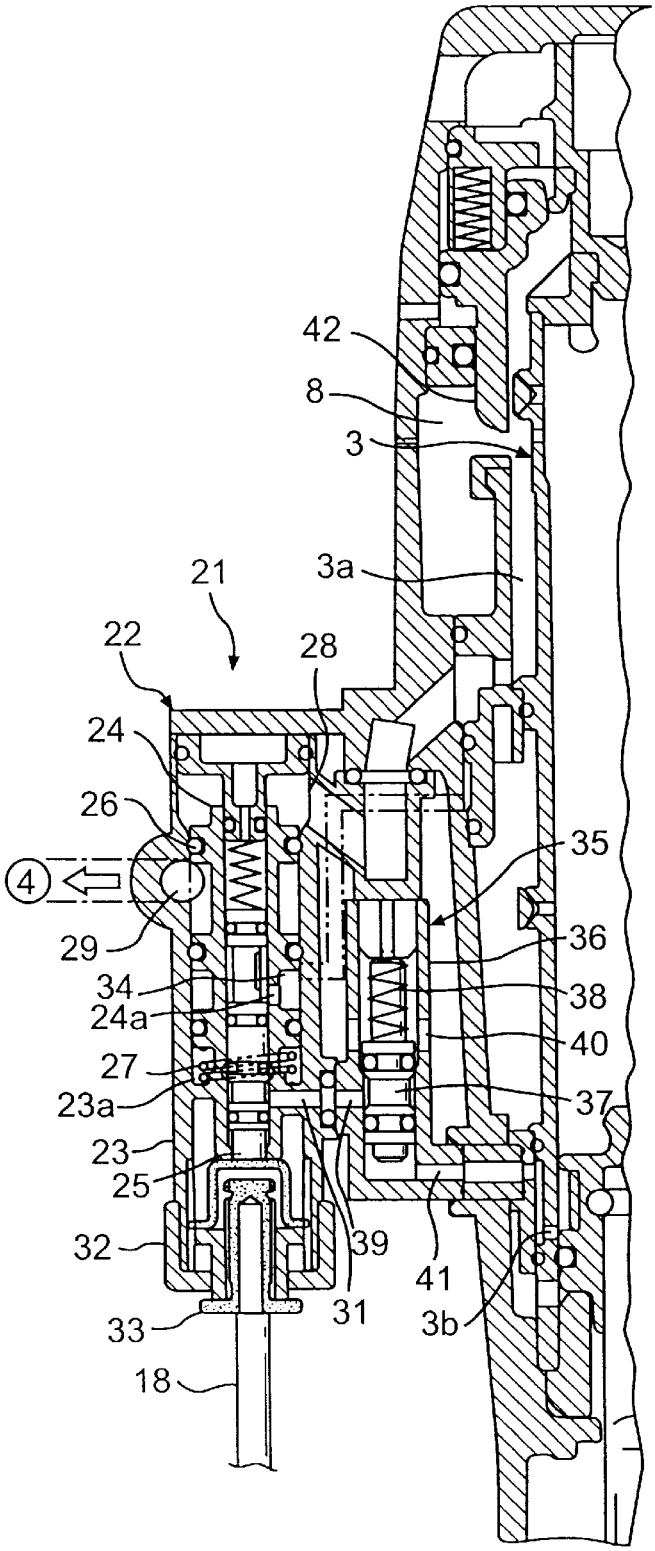
FIGS. 5A and 5B show partial section views of the screw striking machine, showing a state in which a primary open/close valve and secondary open/close valve shown in FIG. 3A are respectively opened.
Figure 5B:
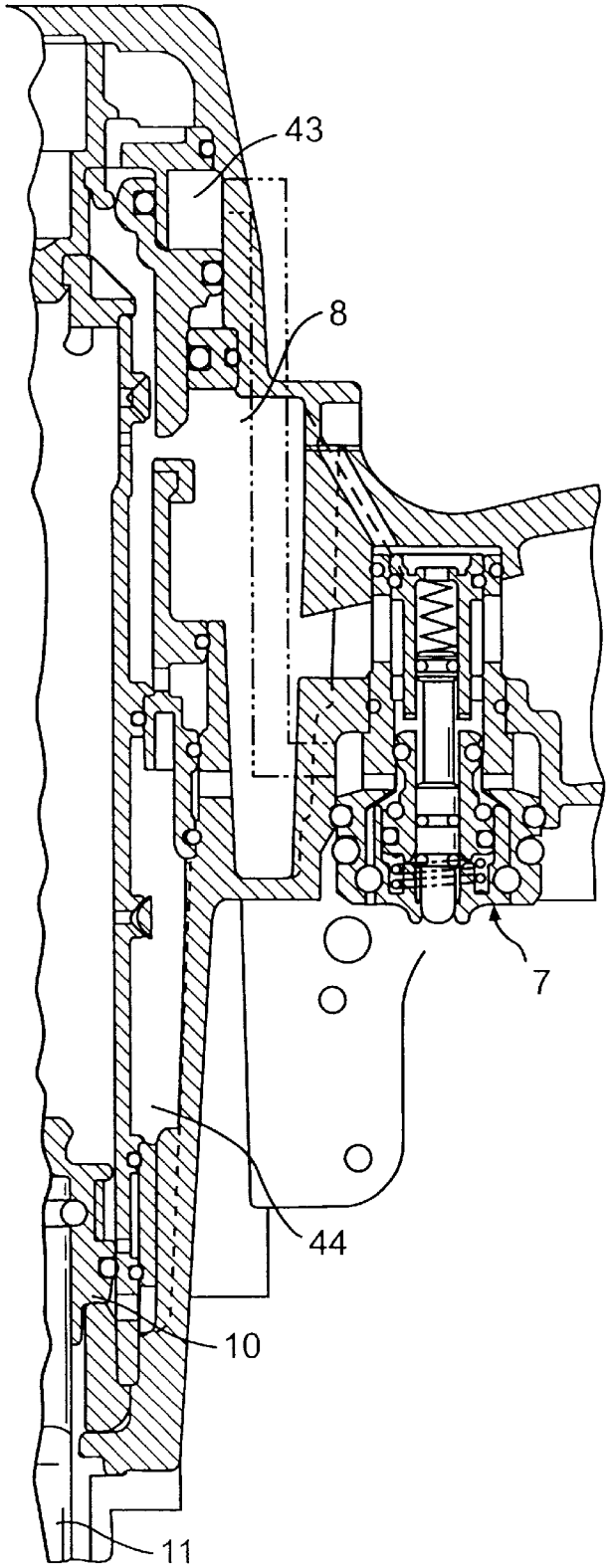

Due to this, the pressure acting on the upper surface of the main spool 24 is caused to differ from the pressure acting on the lower surface thereof, thereby causing the main spool 24 to lower; and, as shown in FIG. 5A, the communication between the entrance port 28 and exit port 29 are cut off by the O ring 26 situated on the upper-most land to thereby cut off the air supply to the air motor 4, causing the air motor 4 to stop.

After stop of the air motor 4, if the screw striking machine is floated up from the member to be screwed, then the contact arm 18 is moved down and is thereby separated from the stem 33. And, the step 33 and pilot spool 25 are respectively moved down to thereby cut off the communication between the pilot air chamber 23*a* and vent port 31; and thus, the pilot port 34 and pilot air chamber 23*a* are allowed to communicate with each other and the pressurized air is thereby supplied to the pilot air chamber 23*a*, so that the main spool 24 is caused to float up to return back to its initial position shown in FIG. 3A.

If the operation of the trigger lever 6 is removed, then the trigger valve 7 is closed to thereby supply the pressurized air to the pilot air chamber 43 of the air pressure cylinder 3, the head valve 42 of the air pressure cylinder 3 is thus lowered down to return back to its initial position shown in FIG. 3A, and the piston 10 and driver bit 11 are respectively moved upward and return back to their respective initial positions due to the pressure of a blow-back chamber 44 which is formed in the outer periphery of the lower portion of the air pressure cylinder 3. At the time when the piston 10 rises up from the bottom dead point and then passes through the exit port 3*b* formed within the air pressure cylinder 3, the pressure supply from within the air pressure cylinder 3 to the pilot port 41 of the secondary open/close valve 35 is cut off, and thus the spool 37 of the secondary open/close valve 35 is moved down to return back to its initial position shown in FIG. 3A to thereby cut off the communication between the entrance port 39 and vent port 40.

Figure 6A:
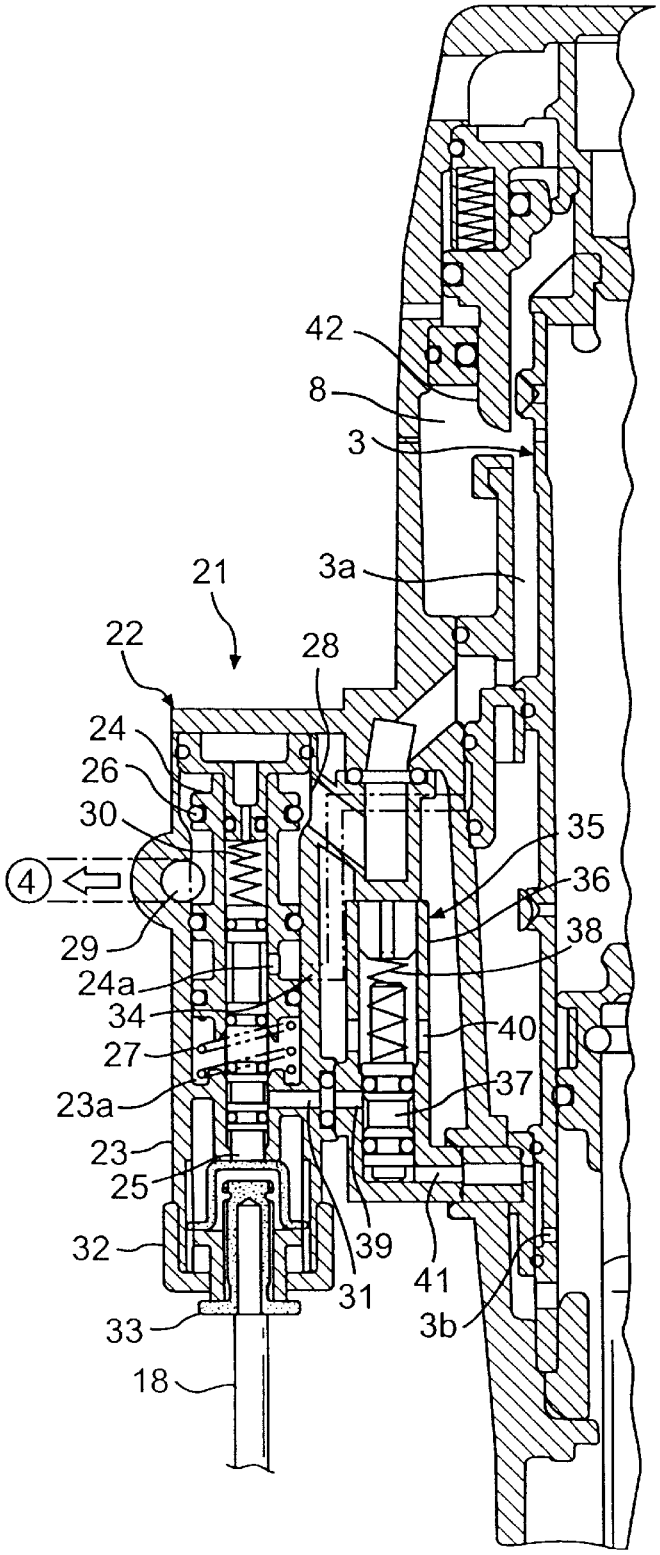
FIGS. 6A and 6B show partial section views of the screw striking machine, showing a state in which a contact arm is pushed into the main body of the screw striking machine by an excessive pressing force.
Figure 6B:
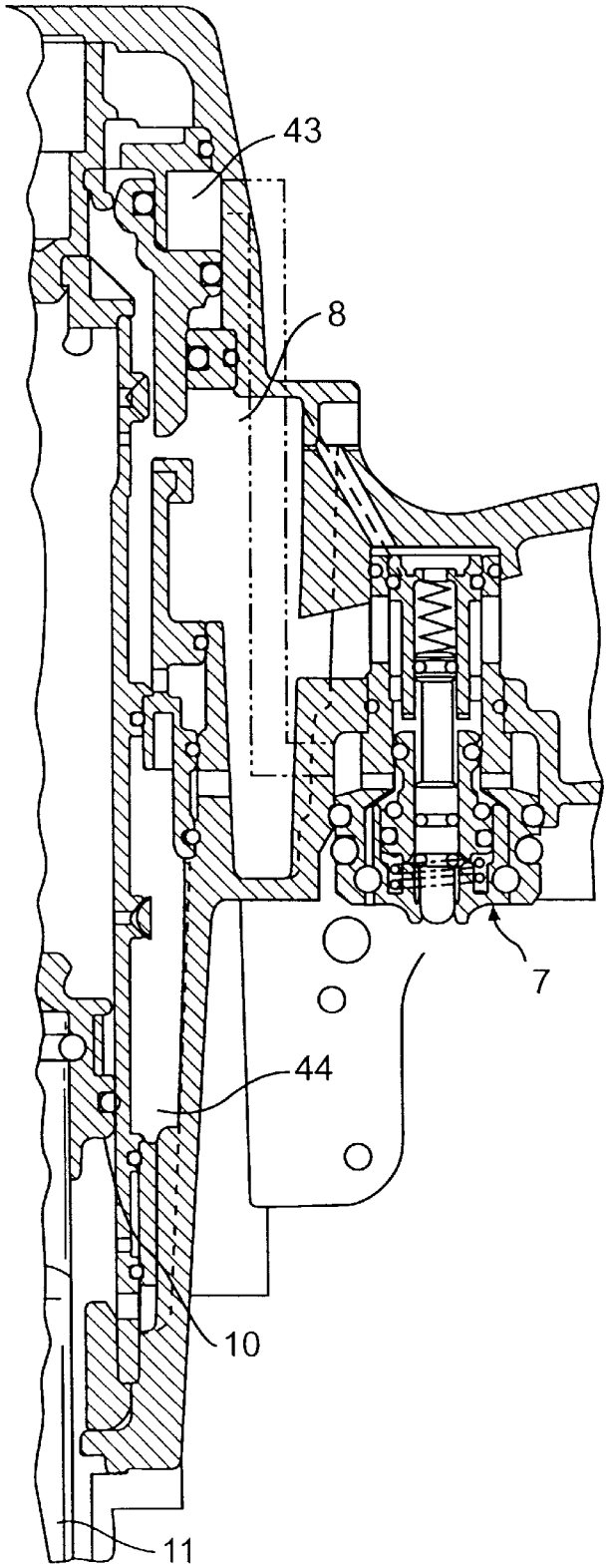

Next, in FIGS. 6A and 6B, a case is shown in which the driver bit 11 and piston 10 are respectively pushed into the screw striking machine due to an excessive pressing load during the screwing operation and thus the contact arm 18 pushes up the stem 33 and pilot spool 25 of the primary open/close valve 22 to their respective air exhaust positions prior to completion of the screwing operation. As shown in FIG. 6A, the pilot spool 25 is pushed and raised by the stem 33, so that not only the pilot air chamber 23*a* of the lower surface of the main spool 24 is in communication with the vent port 31 but also the communication between the pilot air chamber 23*a* of the lower surface of the main spool 24 and the pilot port 34 is cutoff. However, since the screwing operation is prior to completion, the piston 10 is situated at a position where it does not reach the bottom dead point and thus the secondary open/close valve 35 remains closed.

Therefore, the pilot pressure acting on the lower surface of the main spool 24 is not discharged but the main spool 24 maintains its initial position, thereby being able to continue the air supply to the air motor 4. And, at the time when the screwing operation is completed and the piston 10 reaches the bottom dead point, the secondary open/close valve 35 is opened and thus the main spool 24 is lowered down into the state shown in FIG. 5A, thereby causing the air motor 4 to stop.

Figure 4B:
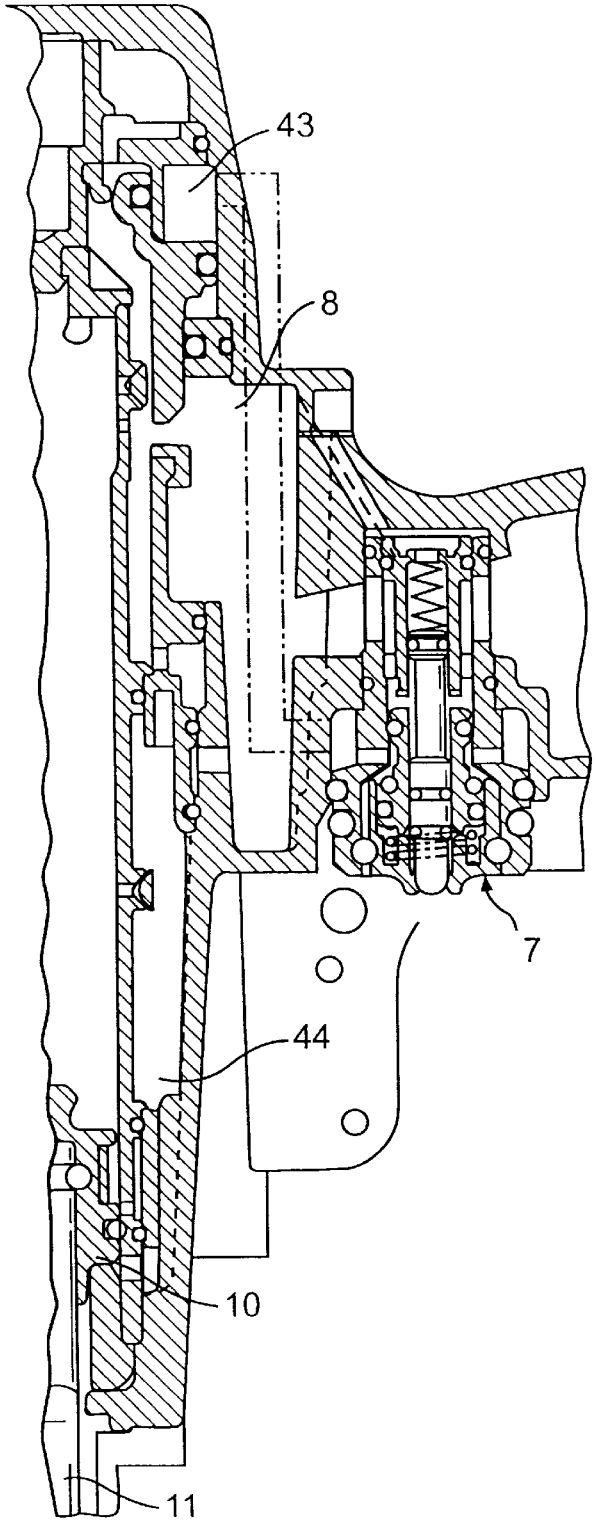

Vice versa, when the load to press the screw striking machine 1 against the member to be screwed is short and thus the screw striking machine 1 is separated from the surface of the member to be screwed due to a reactive force generated when the screw is struck, quite similarly to the state shown in FIGS. 4A and 4B, the piston 10 reaches the bottom dead point prior to completion of the screwing operation to thereby open the secondary open/close valve 35. However, since the contact arm 18 is separated from the stem 33 which is used to operate the primary open/close valve 22, the primary open/close valve 22 maintains its open state and the air motor 4 continues its rotation. At the time when the screwing operation is completed and the contact arm 18 pushes up the stem 33 and pilot spool 25, the air within the pilot air chamber 23*a* of the lower surface of the main spool 24 is discharged through the secondary open/close valve 35 and, as shown in FIG. 5A, the main spool 24 is moved downward to thereby cut off the air supply to the air motor 4, causing the air motor 4 to stop.

Figure 9A:
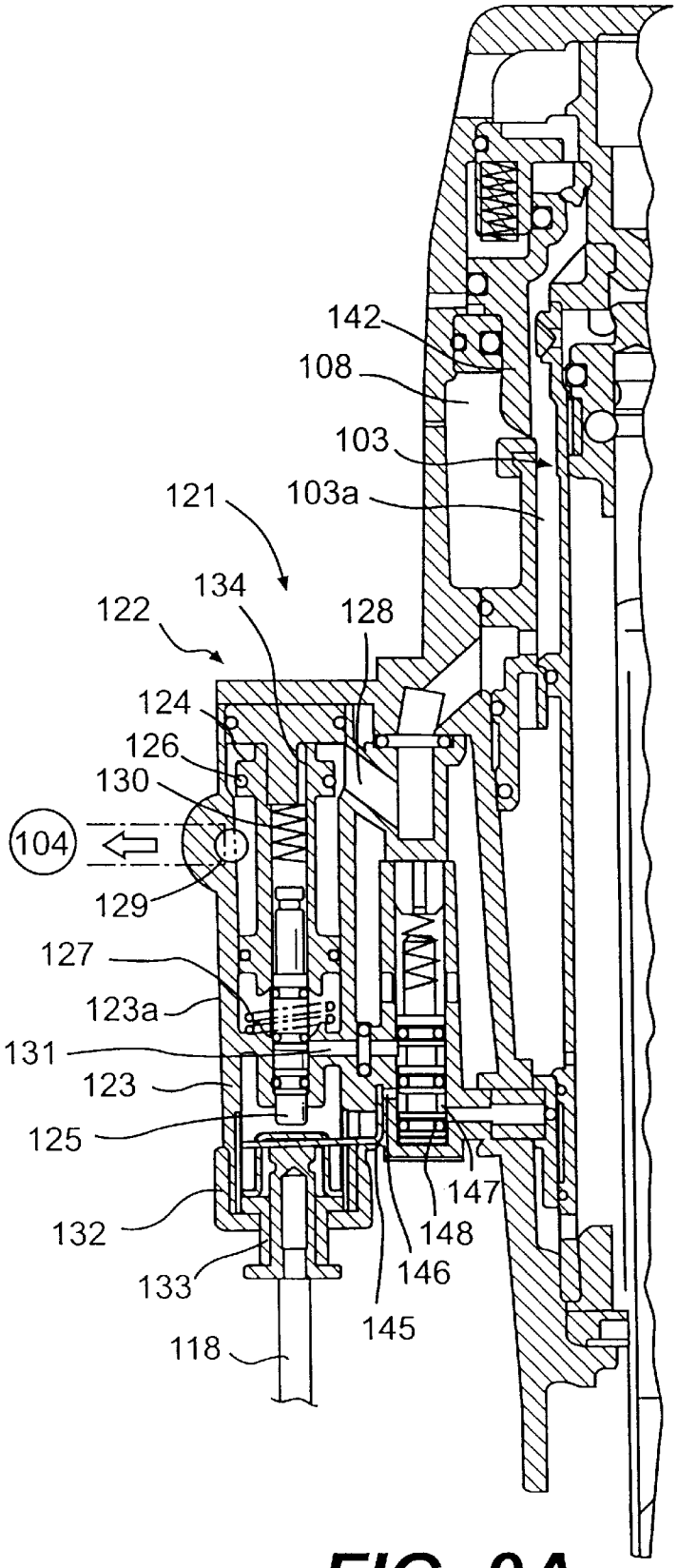
FIGS. 9A and 9B show partial section views of a screw striking machine, showing a second embodiment of an automatic stop device according to the invention.
Figure 9B:
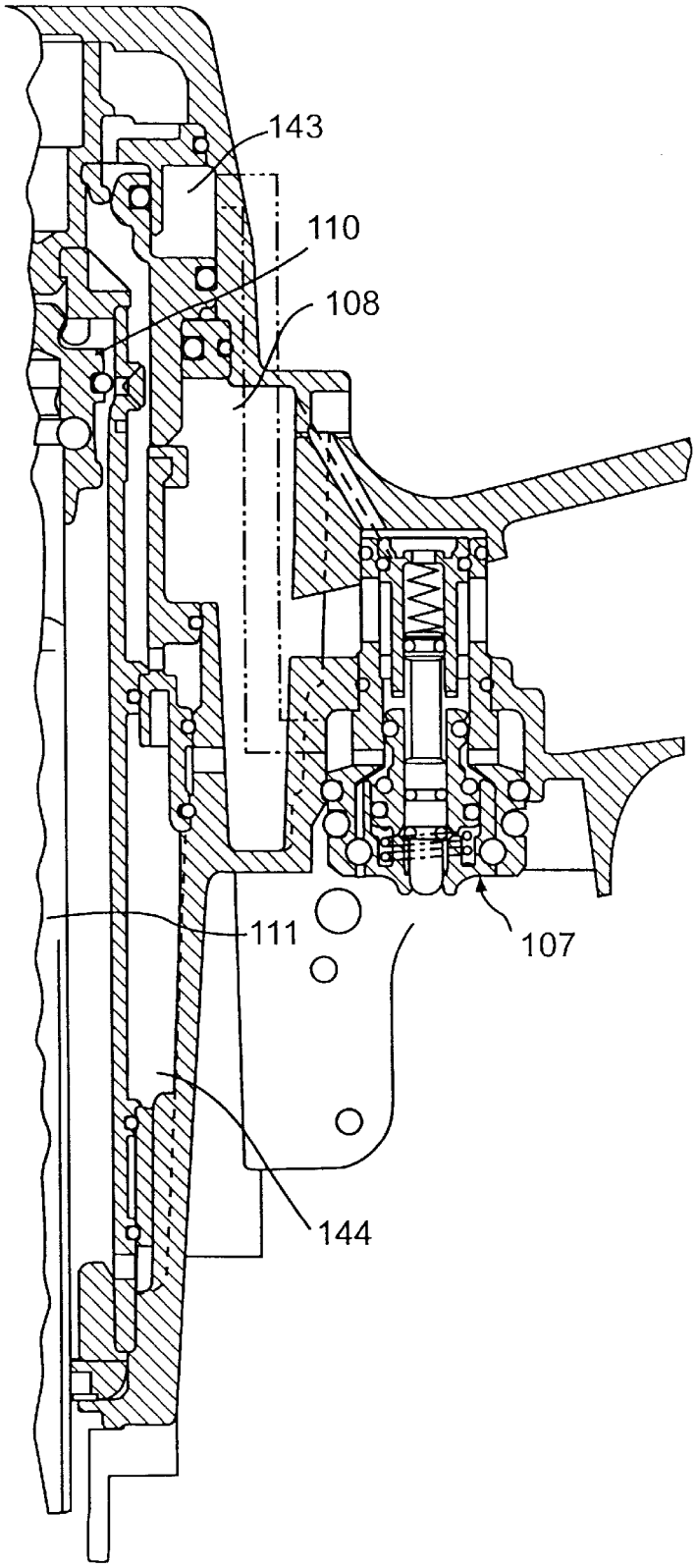

Next, description will be given below of a second embodiment of an automatic stop device 121 according to the invention with reference to FIGS. 9A to 12. FIG. 9A is a partial section view taken along lines 9A—9A in FIG. 7. FIG. 9B is an enlargement of a portion of FIG. 7.

FIG. 9A shows the automatic stop device 121 when it is held in its wait state. The automatic stop device 121 includes a primary open/close valve 122. The primary open/close valve 122 is composed of a cylindrical-shaped main spool 124 inserted into a valve sleeve portion 123 of the screw striking machine, and a small-diameter pilot spool 125 inserted into the lower portion of the main spool 124, while there are mounted O rings 126 respectively on the respective lands of the main spool 124 and pilot spool 125.

The main spool 124 is held at its raised position due to the energizing force of a compression spring 127. At this position, as shown in FIG. 9A, an entrance port 128 formed in the upper portion of the valve sleeve portion 123 and an exit port 129 are always allowed to communicate with each other. The pilot spool 125 is energized downward by a compression spring 130 inserted into the main spool 124 to thereby close a vent port 131 formed in the lower portion of the valve sleeve portion 123. The lower end portion of the pilot spool 125 projects downwardly of the main spool 124 through a center hole formed in the valve sleeve portion 123 and faces a guide portion 133 mounted on a center hole formed in an adjust dial 132 which is mounted on the lower end portion of the valve sleeve portion 123. On a guide portion 133 disposed on the upper end of a branch portion which is branched off in parallel from the middle portion of a contact arm 118, an L-shaped valve body 145 is mounted. On the upper end of the main spool 124, a pilot port 134 is formed, and thus the compressed air of an air chamber 108 can be supplied through the interior portion of the main spool 124 to a pilot air chamber 123*a* which is formed on the lower surface of the main spool 124.

The entrance port 128 of the primary open/close valve 122 is connected to an air chamber 103*a* formed on the head side of the back surface of a piston 110, while the exit port 129 thereof is connected to an air motor 104.

The present automatic stop device 121 further comprises a secondary open/close valve 135 which includes a spool 137 disposed within a valve sleeve portion 136 thereof. The spool 137 is energized downward by a compression spring 138 to thereby normally cut off the communication between an entrance port 139 and a vent port 140 located upwardly of the entrance port 139. The secondary open/close valve 135 includes a pilot port 141 which is formed in the lower portion thereof. The pilot port 141 is connected to an exit port 103*b* which is formed in the vicinity of the lower end portion of an air pressure cylinder 103. When a piston 110 reaches its bottom dead point, the compressed air within the air pressure cylinder 103 can be supplied to the pilot port 141 of the secondary open/close valve 135. The vent port 131 of the primary open/close valve 122 is connected to the entrance port 139 of the secondary open/close valve 135. When the piston 110 reaches the neighboring portion of the bottom dead point, the secondary open/close valve 135 is opened due to the compressed air acting on the back surface of the piston 110, so that the pilot air chamber 123*a* formed on the lower surface of the main spool 124 of the primary open/close valve 122 is allowed to communicate with the open air from the vent port 140 through the vent port 131 and entrance port 139. That is, the exit port 103*b* and pilot port 141 cooperate together in forming an air passage in communication with an air exhaust hole 146 (to be discussed later) which is used to discharge or exhaust the compressed air acting on the back surface of the piston 110, while the secondary open/close valve 135 is disposed in the intermediate portion of the thus formed air passage.

Next, in the pilot port 141 forming the above-mentioned air passage, an air chamber 147 is formed and used to actuate the secondary open/close valve 135. In the air chamber 147, an air exhaust hole 146 is formed and used to exhaust the compressed air, while the air exhaust hole 146 is structured such that it can be opened and closed in linking with the upward and downward motion of a contact arm 118.

While an O ring 148 is disposed on the lower-most end portion of the stem 137 of the secondary open/close valve 135, the outside diameter of the O ring 148 is set such that it is smaller than the inside diameter of the lower portion of the air chamber 147 but is almost equal to the inside diameter of the upper portion thereof.

Figure 7:
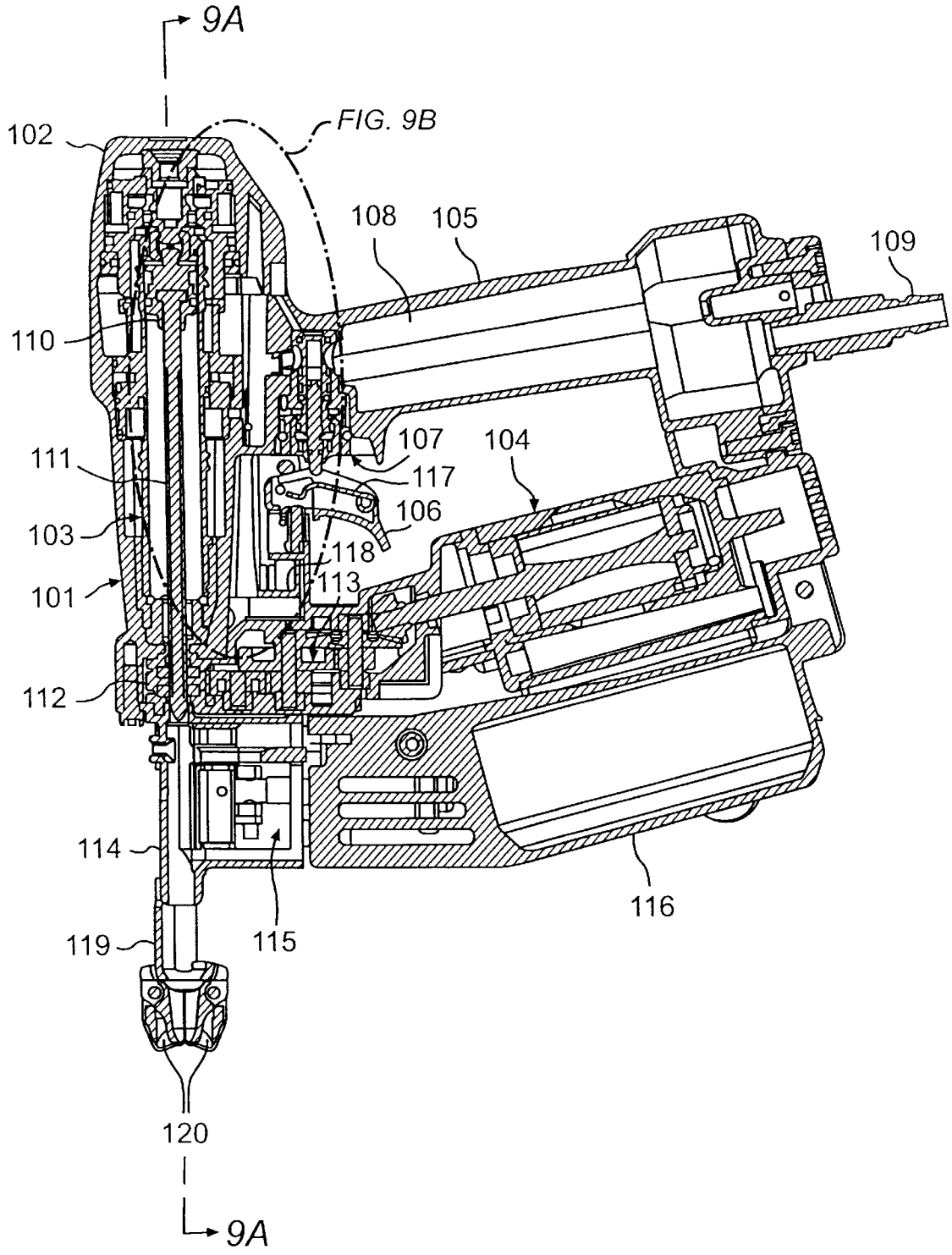
FIG. 7 is a section view of a screw striking machine according to the second embodiment of the present invention.
Figure 8:
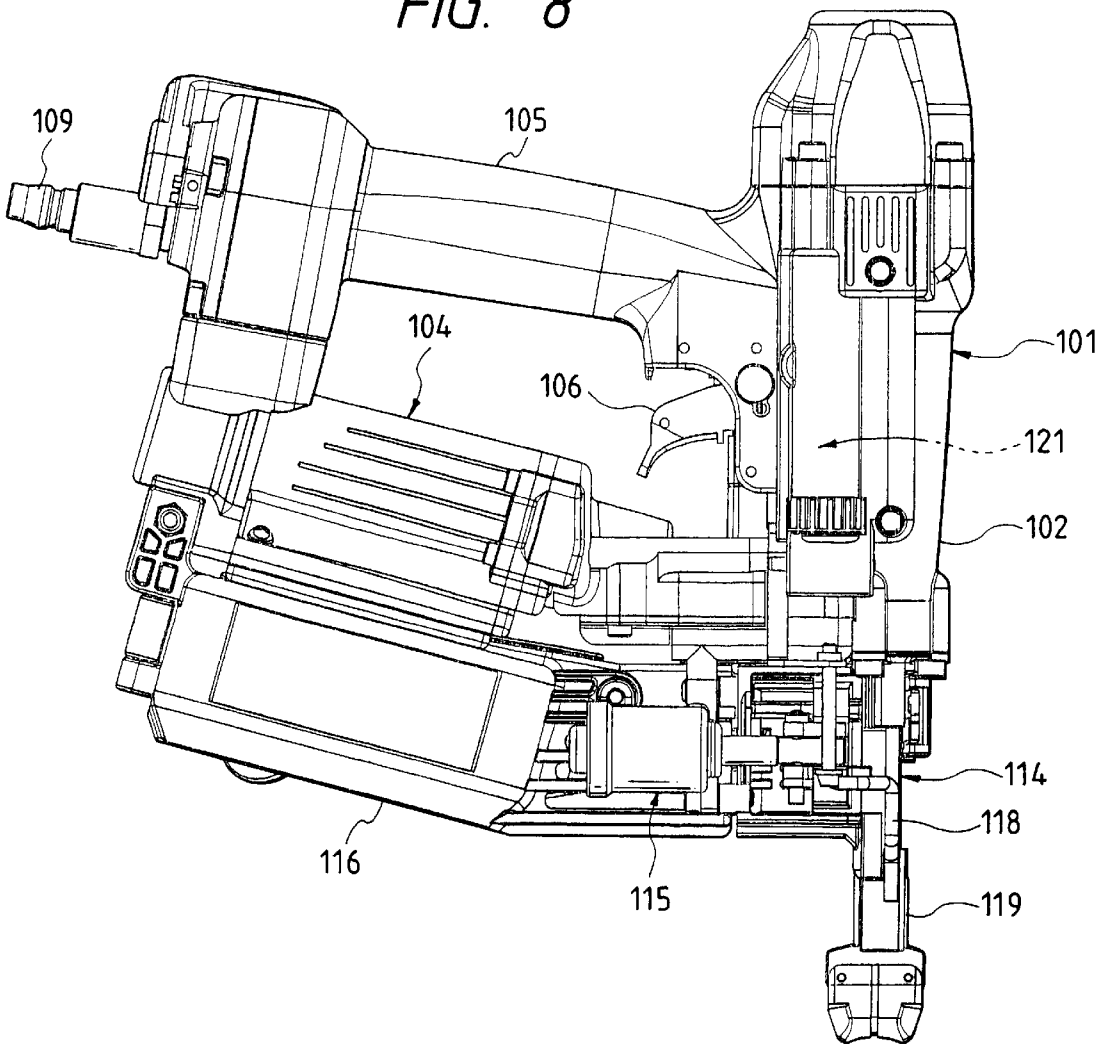
FIG. 8 is a side view of a screw striking machine according to the second embodiment of the present invention.

Next, description will be given below of the operation of the above-mentioned screw striking machine. At first, the leading end portion of the screw guide 119 shown in FIGS. 7 and 8 is pressed against the surface of the member to be screwed to thereby push the contact arm 118 into the screw striking machine main body until it is butted against the contact arm stopper (not shown). In this state, if the trigger lever 106 is actuated, then the trigger valve 107 is opened, so that the compressed air of the pilot air chamber 143 acting on the outer edge portion of the upper surface of the head valve 142 of the air pressure cylinder 103 shown in FIGS. 9A and 9B is discharged to the open air, thereby causing the head valve 142 to move in the upward direction in FIGS. 9A and 9B. In response to this, the compressed air flows from the air chamber 108 formed in the outer periphery of the air pressure cylinder 103 into the air pressure cylinder 103. Due to this, as shown in FIGS. 9A and 9B, the piston 110 and driver bit 111 are respectively moved downward to thereby strike the screw set within the nose portion 114 of the screw striking machine and, at the same time, the air motor 104 drives and rotates the driver bit 111, while the piston is moved up to the neighboring portion of the bottom dead point.

If the screw is struck into the member to be screwed, then the locking of the contact arm 118 by the contact arm stopper is removed and the screw is screwed further by the air motor 104. As the screw is screwed, the piston 110 moves toward the bottom dead point and also the screw striking machine approaches the member to be screwed, so that the contact arm 118 is pushed into the screw striking machine main body further deeper.

Figure 11:
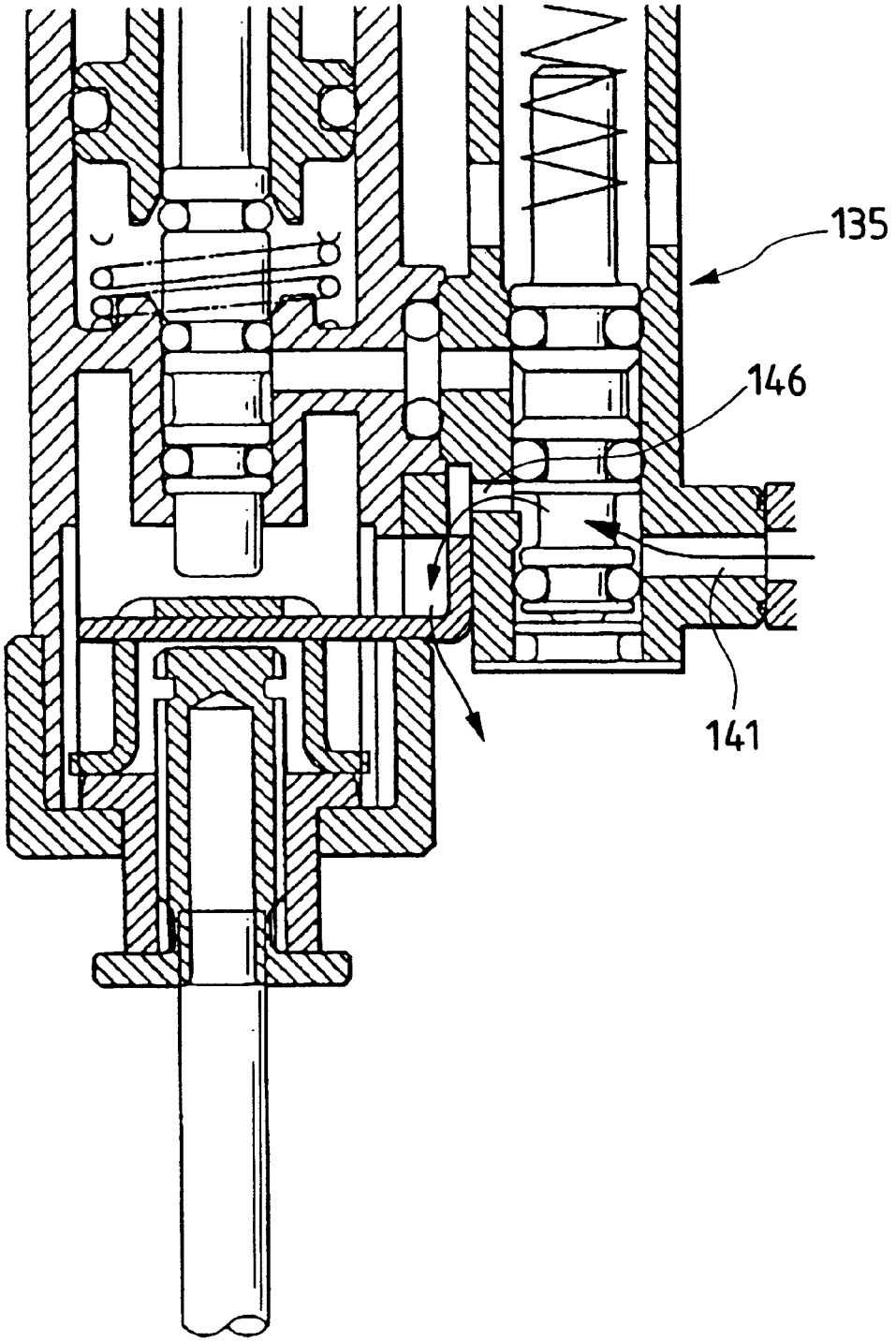
FIG. 11 is an enlarged view of a portion of FIG. 10.

If the piston 110 passes through the exit port 103*b* of the air pressure cylinder 103 and reaches the bottom dead point, then the compressed air within the air pressure cylinder 103 is supplied through the exit port 103*b* to the pilot port 141 which forms the air passage. However, since this compressed air, as shown in FIG. 11, is discharged from the air exhaust hole 146 to the open air, the compressed air is freely discharged without any control.

Figure 12:
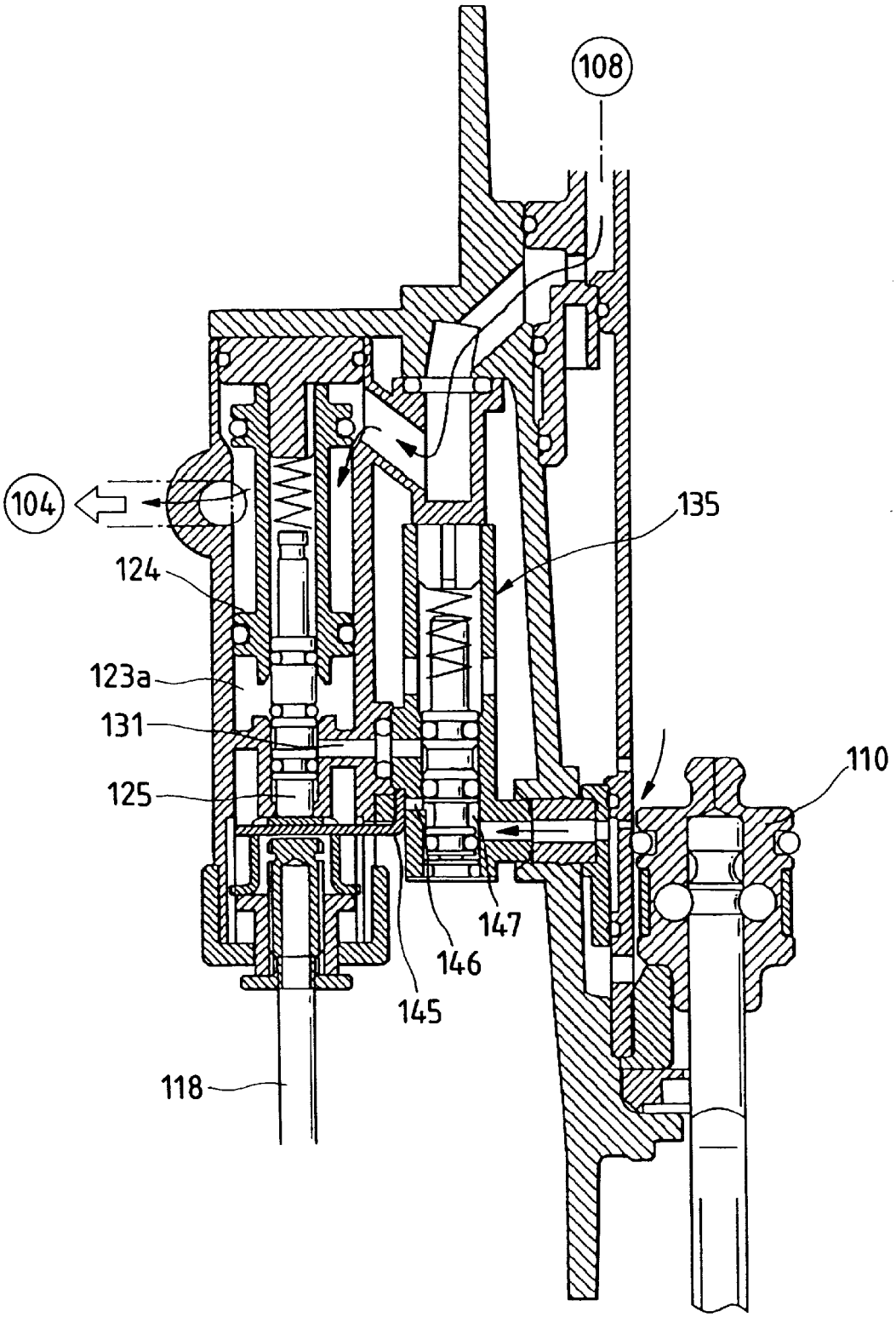
FIG. 12 a partial section view of the screw striking machine, showing a state in which a primary open/close valve and secondary open/close valve shown in FIG. 9A are respectively opened.
Figure 13:
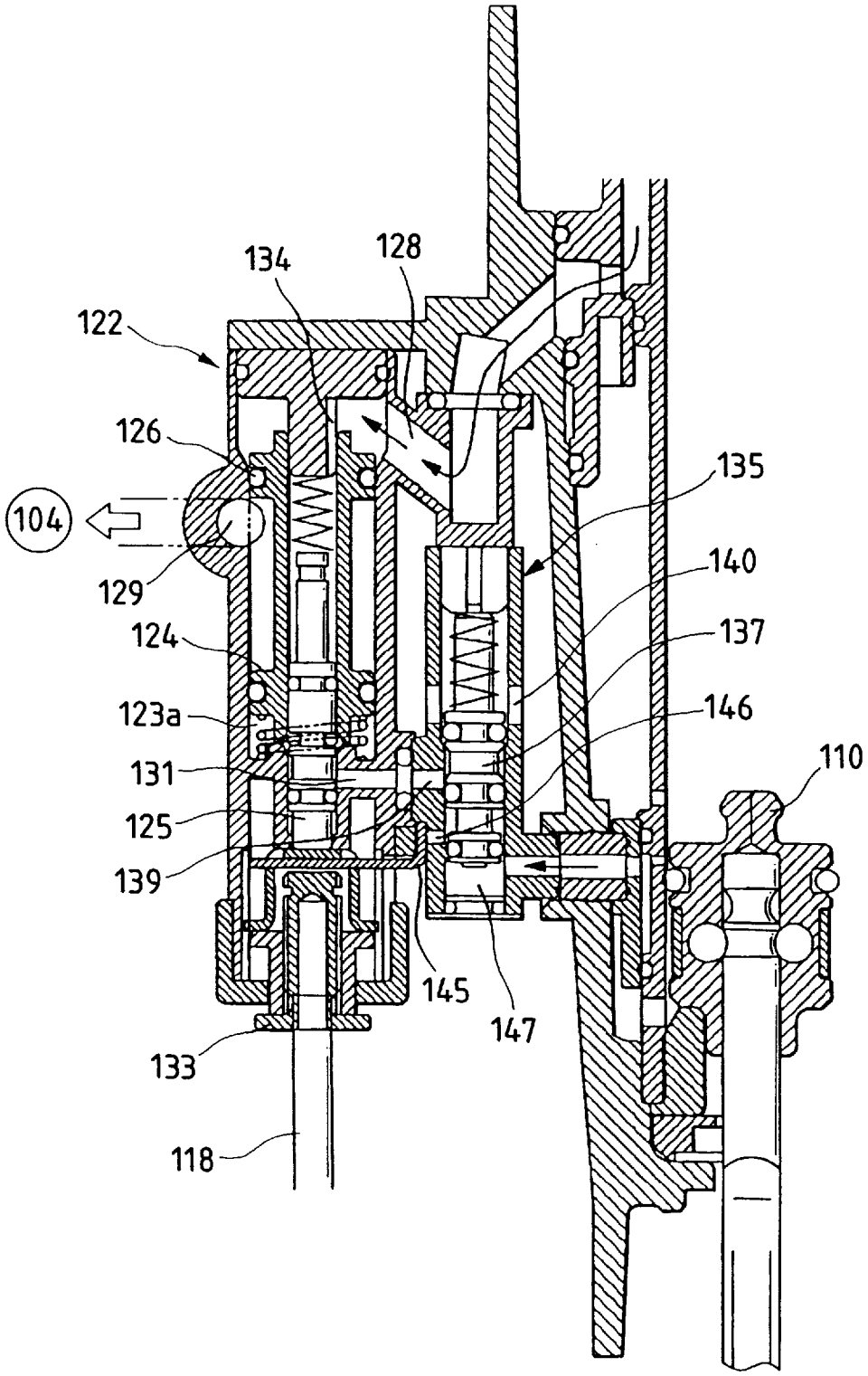
FIG. 13 is a partial section view of the screw striking machine, showing a state in which an air motor is caused to stop after completion of a screwing operation; and, FIG. 14 is a partial section view of the screw striking machine, showing a state in which the screw striking machine is pressed by an excessive pressing force.

On completion of the screwing operation, as shown in FIG. 12, the contact arm 118 pushes up the guide portion 133 to thereby slide the pilot spool 125 of the primary open/close valve 122 in the upward direction. If the pilot spool 125 is moved upward, then the pilot air chamber 123*a* formed in the lower surface of the main spool 124 and vent port 131 are respectively opened. When the screw striking machine is pushed in up to the stroke end thereof, the contact arm 118 pushes up the pilot spool 125 of the primary open/close valve 122 and, at the same time, the L-shaped valve body 145 closes the air exhaust hole 146 from which the compressed air of the secondary open/close valve 135 is being discharged to the open air without any control. Due to this, the air chamber 147 is filled with the compressed air to thereby push up the secondary open/close valve 135 in such a manner as shown in FIG. 13, so that the compressed air within the pilot air chamber 123*a* of the primary open/close valve 122 communicates with the open air through the vent port 131, entrance port 139 and vent port 140. As a result of this, the pilot pressure acting on the lower surface of the main spool 124 is discharged to the open air from the vent port 140 through the vent port 131 and secondary open/close valve 135. This causes a difference between the pressures respectively acting on the upper and lower surfaces of the main spool 124 to thereby move down the main spool 124, so that the O ring 126 disposed on the upper-most land cuts off the communication between the entrance port 128 and exit port 129 to thereby cut off the air supply to the air motor 104, causing the air motor 104 to stop.

Figure 10:
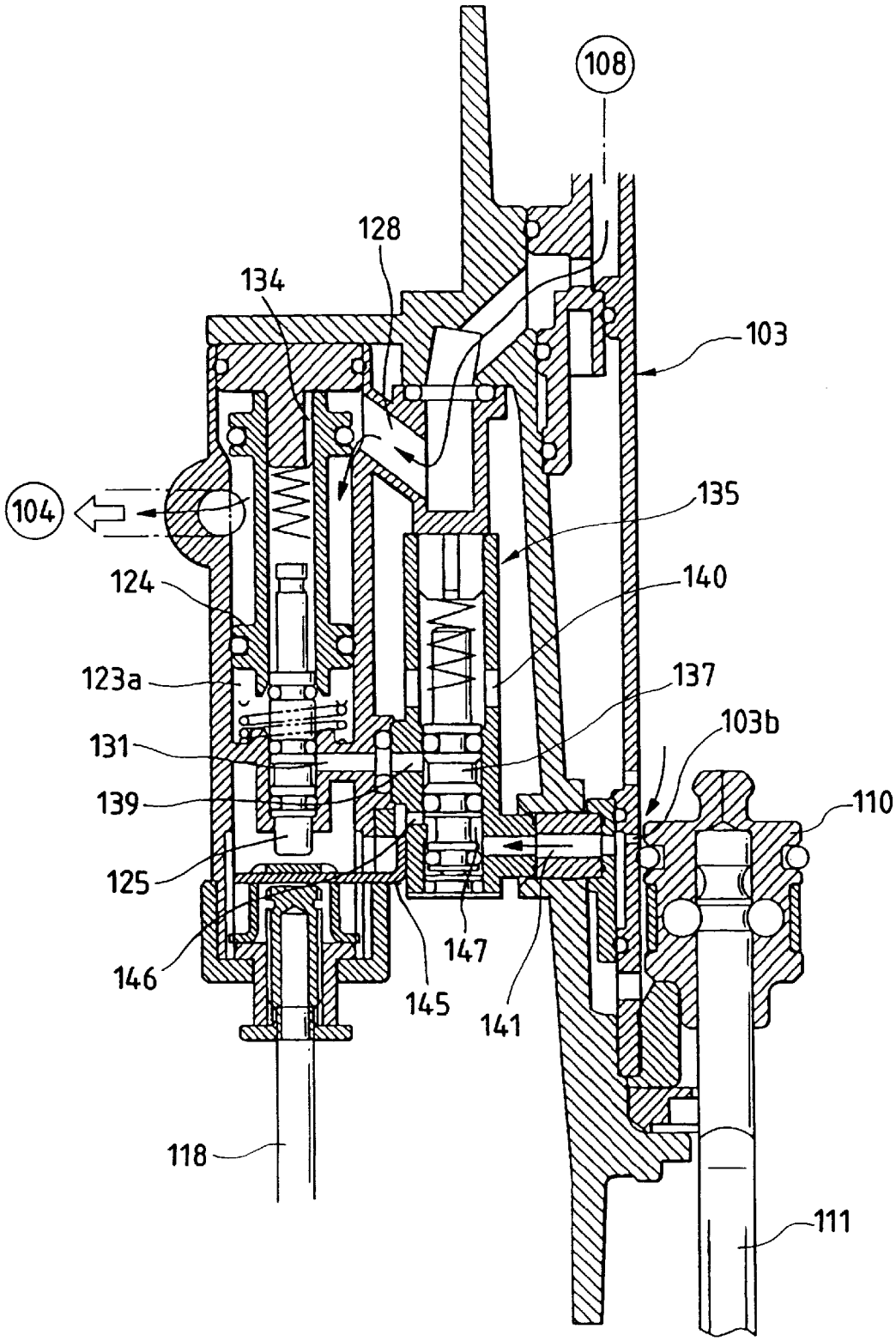
FIG. 10 is a partial section view of the screw striking machine, showing a state in which a secondary open/close valve shown in FIG. 9A is opened.

After stop of the air motor 104, if the screw striking machine 101 is floated up from the member to be screwed, then the contact arm 118 is lowered down and is thereby separated from the pilot spool 125. In response to this, as shown in FIG. 10, the L-shaped valve body 145 opens the air exhaust hole 146 to thereby resume the discharge of the compressed air within the air chamber 147, so that the stem 133 of the secondary open/close valve 135 is moved down to return back to its initial position. That is, the compressed air is discharged to the air without any control, and the communication between the entrance port 139 and vent port 140 is cut off. If the pilot spool 125 is moved down, then the communication between the pilot air chamber 123*a* and vent port 131 is cut off and, at the same time, the pilot port 134 and pilot air chamber 123*a* are allowed to communicate with each other and thus the compressed air is supplied from the entrance port 128 to the pilot air chamber 123*a*, thereby causing the main spool 124 to float up and return back to its initial position.

If the operation of the trigger 106 is removed, then the trigger valve 107 is closed, so that the compressed air is supplied to the pilot air chamber 143 of the air pressure cylinder 103 to thereby move down the head valve 142 of the air pressure cylinder 103 and is thereby returned back to its initial position shown in FIGS. 9A and 9B, while the piston 110 and driver bit 111 are moved up and returned back to their respective initial positions due to the pressure of a blow-back chamber 144 formed in the outer periphery of the lower portion of the air pressure cylinder 103. At the time when the piston 110 moves upward and passes through the exit port 103*b* within the air pressure cylinder 103, the pressure supply from inner space of the air pressure cylinder 103 to the pilot port 141 of the secondary open/close valve 135 is cut off.

Figure 14:
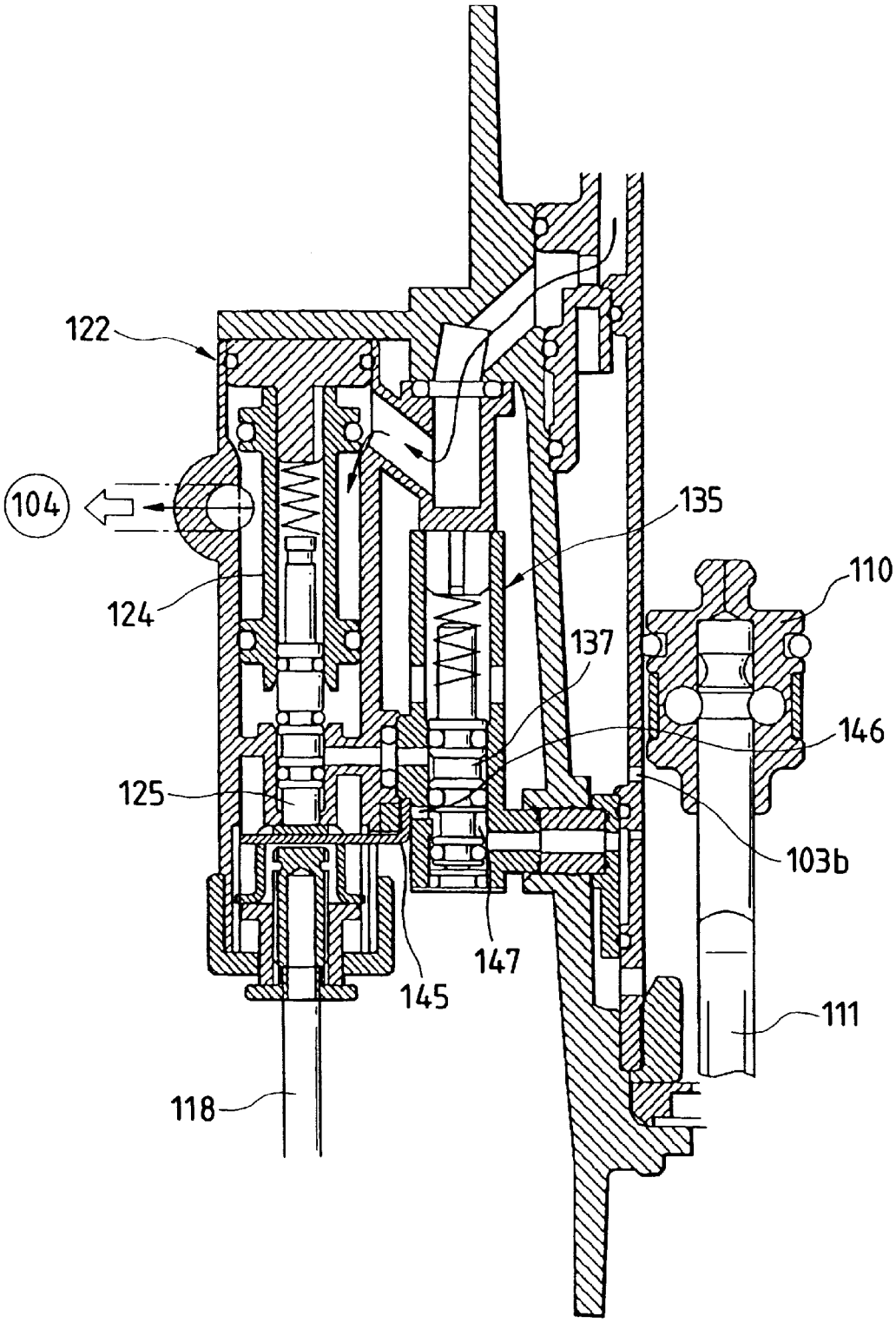

Next, when the screw striking machine is suddenly pressed against the member to be screwed up to the stroke end thereof by a great force during the screwing operation, the state of the compressed air is switched from the state in which the piston 110, as shown in FIG. 10, reaches the bottom dead point once and thus the compressed air is allowed to flow from the air passage 141 to the air chamber 147 of the secondary open/close valve 135, to the state in which, as shown in FIG. 14, the driver bit 111 and piston 110 are respectively pushed into the screw striking machine main body and thus the compressed air, reversely to the above, is discharged from the air passage 141.

Although the compressed air is flowing into the air chamber 147, because the compressed air is being discharged from the air exhaust hole 146 to the open air without any control, the spool 137 of the secondary open/close valve 135 is prevented from rising (that is, it is prevented from being actuated) during the screwing operation. After then, when the piston 110 is suddenly pushed up in such a manner as shown in FIG. 13, the flow of the compressed air into the air passage 141 is cut off and thus the screw striking machine is pressed up to the stroke end thereof. Even if the contact arm 118 actuates the pilot spool 125, then the air exhaust hole 146 is simply closed by the L-shaped valve body 145 due to the cutoff of the flow of the compressed air into the air passage 141, so that the secondary open/close valve 135 and the main spool 124 of the primary open/close valve 122 are not operated, whereby the air motor keeps on its operation. Further, as shown in FIG. 13, after the piston 110 reaches again the bottom dead point and is completely tightened down to a set depth, if the contact arm 118 pushes up the guide portion 133 to close the air exhaust hole 146 and the compressed air is thereby allowed to flow into the air chamber 147 of the secondary open/close valve 135, then the valve stem 137 is pushed up and thus the secondary open/close valve 135 is actuated. As a result of this, the compressed air of the pilot air chamber 123*a* is exhausted and thus the main spool 124 of the primary open/close valve 122 is also moved down to thereby actuate the open/close valve 122, thereby causing the primary air motor to stop.

Vice versa, when the load to press the screw striking machine 101 against the member to be screwed is short and thus the screw striking machine 101 is separated from the surface of the member to be screwed due to a reactive force produced when the screw striking machine 101 strikes the screw into the member to be screwed, quite similarly to the state shown in FIG. 14, even if the piston 110 reaches the bottom dead center prior to completion of the screwing operation, the secondary open/close valve 135 is not actuated; and also, since the contact arm 118 is separated from the pilot spool 125 for operating the primary open/close valve 122, the primary open/close valve 122 also maintains its open state, so that the air motor 104 keeps on its rotational movement. When the piston 110 moves down, the screwing operation is completed and the contact arm 118 pushes up the pilot spool 125. Next, the secondary open/close valve 135 is opened, and the air of the pilot air chamber 123*a* formed on the lower surface of the main spool 124 is discharged through the secondary open/close valve 135. Then, as shown in FIG. 13, the main spool 124 is moved down to thereby cut off the air supply to the air motor 104, thereby causing the air motor 104 to stop its rotational movement.

As has been described heretofore, an automatic stop device for a screw striking machine according to the invention is structured such that the primary open/close valve is closed to thereby stop the air supply to the air motor when not only the contact arm for operating the primary open/close valve disposed in the air supply passage to the air motor reaches the bottom dead point but also the piston and driver bit respectively reach the neighboring portions of their respective bottom dead points.

Therefore, even when the contact arm is pushed up to the top dead point position due to an excessive pressing load prior to completion of the screwing operation, or even when the screw striking machine is separated from the surface of the member to be screwed due to the small pressing load and the piston is thereby caused to reach the bottom dead point, if the two conditions are satisfied, that is, not only the air motor keeps on rotation and the contact arm reaches the top dead point but also the piston reaches the bottom dead point, then the primary open/close valve is closed to thereby stop the operation of the air motor.

As described above, since the air motor is sure to continue its rotation until the screwing operation is completed regardless of the pressing load applied to the screw striking machine, there is no possibility that the poor screw tightening can occur, and the amount of screwing can be controlled to a constant amount, thereby being able to not only stabilize the finishing accuracy of the screw tightening but also facilitate the screwing operation.

In other words, even if the screw striking machine is strongly pressed against the member to be screwed during the screwing operation and the piston is thereby pushed into the screw striking machine main body, the air motor can be effectively prevented against stop until a given screwing operation can be completed. That is, only when the two conditions are satisfied, the primary open/close valve can be operated to thereby cause the air motor to stop: in particular, one of the two conditions is that the contact arm reaches the top dead point; and, the other is that the piston reaches the bottom dead point. In this manner, since the air motor is able to continue its rotational movement until the given screwing operation is completed regardless of the pressing load applied to the screw striking machine, there is eliminated a possibility that the poor screw tightening can occur.

The invention is not limited to the above-mentioned embodiments, but the invention can be changed and modified in other various manners without departing from the technical scope of the invention, and, of course, such changes and modifications fall within the scope of the invention.

The present invention is based on Japanese Patent Applications No. Hei. 10-177805 and No. Hei. 11-137877, which are incorporated herein by references.

What is claimed is:

1. A screw striking machine including a driver bit extending from a leading end of a nose portion of the screw striking machine and having a bit to be engaged with the head of a screw, an air pressure cylinder having a piston which said driver bit is rotatably connected thereto, an air motor driving said piston of said air pressure cylinder to strike said screw and rotationally driving said driver bit to screw said screw, and an automatic stop mechanism comprising:

a primary open/close valve disposed in an air supply passage to said air motor;

a contact arm freely slidable along the nose portion of said screw striking machine, projecting from the leading end of the nose portion, and stopping said air motor by closing said primary open/close valve when said contact arm is pushed into a main body of said screw striking machine as said screw is screwed; and an air passage in which pressurized air passes from a space defined by a back surface of said piston in said piston when said piston reaches approximately one end of its travel, wherein pressure of the pressurized air supplied through said air passage and movement of said contact arm into the main body of the screw striking machine cooperatively cause said primary open/close valve to close when said piston reaches the approximately one end of its travel.

2. A screw striking machine according to claim 1 further comprising a gear including a center hole with a spline groove in said screw striking machine, wherein said driver bit includes a spline shaft to be inserted into said gear and is rotatably driven by said air motor through said gear.

3. A screw striking machine according to claim 1, wherein said pressure of the pressurized air is supplied from said space in said piston to said primary open/close valve when said piston reaches the approximately one end of its travel.

4. A screw striking machine according to claim 1 further comprising:

a secondary open/close valve of pilot operation type including an entrance port and a pilot port; and a stem opening and closing a pilot air chamber of said primary open/close valve, wherein said primary open/close valve is pilot operation type and includes a vent port connected to said pilot air chamber, said vent port is connected to said entrance port of said secondary open/close valve, said air passage is connected to said pilot port of said secondary open/close valve, and said primary open/close valve is closed by discharge of pressurized air from said pilot air chamber through said secondary open/close valve when said piston reaches the approximately one end of its travel to thereby open said secondary open/close valve and said contact arm pushes said stem.

5. A screw striking machine according to claim 1 further comprising:

a pilot air chamber in said primary open/close valve;

a secondary open/close valve opening and closing said air passage communicating with said pilot air chamber with respect to the open air due to the pressurized air acting on the back surface of said piston when said piston reaches the approximately one end of its travel; and an air chamber actuating said secondary open/close valve in said air passage and including an exhaust hole to discharge the pressurized air and said exhaust hole being opened and closed in linking with the upward and downward movements of said contact arm, wherein said primary open/close valve is pilot operation type, and said primary open/close valve is closed by discharge of the pressurized air in said pilot chamber of said primary open/close valve after the pressurized air has actuated said secondary open/close valve when said piston reaches the approximately one end of its travel and said contact arm closes said exhaust hole after the screwing operation is performed.

6. A screw striking machine comprising:

a driver bit extending from a leading end of a nose portion of the screw striking machine and including a bit to be engaged with the head of a screw;

an air pressure cylinder including a piston which said driver bit is rotatably connected thereto;

an air motor driving said piston of said air pressure cylinder to strike said screw, and rotationally driving said driver bit to screw said screw;

a primary open/close valve disposed in an air supply passage to said air motor;

a contact arm freely slidable along the nose portion of said screw striking machine, projecting from the leading end of the nose portion, and stopping said air motor by closing said primary open/close valve when said contact arm is pushed into a main body of said screw striking machine as said screw is screwed; and an air passage in which pressurized air passes from a space defined by a back surface of said piston in said piston when said piston reaches the approximately one end of its travel, wherein pressure of the pressurized air supplied through said air passage and movement of said contact arm into the main body of the screw striking machine cooperatively cause said primary open/close valve to close when said piston reaches approximately one end of its travel.

7. A screw striking machine according to claim 6 further comprising a gear including a center hole with a spline groove, wherein said driver bit includes a spline shaft to be inserted into said gear and is rotatably driven by said air motor through said gear.

8. A screw striking machine according to claim 6, wherein said pressure of the pressurized air is supplied from said space in said piston to said primary open/close valve when said piston reaches the approximately one end of its travel.

9. A screw striking machine according to claim 6 further comprising:

a secondary open/close valve of pilot operation type including an entrance port and a pilot port; and a stem opening and closing a pilot air chamber of said primary open/close valve, wherein said primary open/close valve is pilot operation type and includes a vent port connected to said pilot air chamber, said vent port is connected to said entrance port of said secondary open/close valve, said air passage is connected to said pilot port of said secondary open/close valve, and said primary open/close valve is closed by discharge of pressurized air from said pilot air chamber through said secondary open/close valve when said piston reaches the approximately one end of its travel to thereby open said secondary open/close valve and said contact arm pushes said stem.

10. A screw striking machine according to claim 6 further comprising:

a pilot air chamber in said primary open/close valve;

a secondary open/close valve opening and closing said air passage communicating with said pilot air chamber with respect to the open air due to the pressurized air acting on the back surface of said piston when said piston reaches the approximately one end of its travel; and an air chamber actuating said secondary open/close valve in said air passage and including an exhaust hole to discharge the pressurized air and said exhaust hole being opened and closed in linking with the upward and downward movements of said contact arm, wherein said primary open/close valve is pilot operation type, and said primary open/close valve is closed by discharge of the pressurized air in said pilot chamber of said primary open/close valve after the pressurized air has actuated said second open/close valve when said piston reaches the approximately one end of its travel and said contact arm closes said exhaust hole after the screwing operation is performed.

* * * * *